US007591465B2

(12) United States Patent
Sato

(10) Patent No.: US 7,591,465 B2
(45) Date of Patent: Sep. 22, 2009

(54) DELIVERY

(75) Inventor: Fuminori Sato, Noda (JP)

(73) Assignee: Komori Corporation, Tokyo (JP)

( * ) Notice: Subject to any disclaimer, the term of this patent is extended or adjusted under 35 U.S.C. 154(b) by 247 days.

(21) Appl. No.: 11/116,361

(22) Filed: Apr. 28, 2005

(65) Prior Publication Data

US 2005/0242498 A1 Nov. 3, 2005

(30) Foreign Application Priority Data

Apr. 30, 2004 (JP) ..... 2004-136133
Apr. 4, 2005 (JP) ..... 2005-107122

(51) Int. Cl.
*B65H 29/00* (2006.01)

(52) U.S. Cl. ..... 271/187; 271/315; 271/223

(58) Field of Classification Search ..... 271/187, 271/315, 306, 176, 207, 213, 223
See application file for complete search history.

(56) References Cited

U.S. PATENT DOCUMENTS 4,120,491 A * 10/1978 Lang ..... 271/303
4,834,361 A * 5/1989 Fenske et al. ..... 271/187
4,971,303 A 11/1990 Lange et al.
5,065,997 A * 11/1991 Butts et al. ..... 271/187
6,131,903 A * 10/2000 Schaefer et al. ..... 271/312
2001/0040340 A1 11/2001 Neary et al.
2001/0042958 A1* 11/2001 Kishine et al. ..... 271/315
2003/0021659 A1* 1/2003 Michler ..... 414/315
2004/0006309 A1* 1/2004 Rusnak ..... 604/131

FOREIGN PATENT DOCUMENTS

EP WO 00/24662 * 5/2000
JP 2000-86039 A 3/2000
WO WO-94/14692 A1 7/1994

* cited by examiner

*Primary Examiner*—Patrick H Mackey
*Assistant Examiner*—Thomas A Morrison
(74) *Attorney, Agent, or Firm*—Birch, Stewart, Kolasch & Birch, LLP

(57) ABSTRACT

Included are: a fan wheel for holding and rotationally transporting signatures delivered from a printing press; a pair of side guides for restricting the signatures in the width direction which are held in the fan wheel; a side-guide rodless air cylinder for moving a side guide between side-guide guide positions for guiding the signatures and side-guide retraction positions for retraction to the outside of the fan wheel in the radial direction thereof; a side-guide drive motor for moving the side guide in the width direction of the signatures; and a controller which controls the side-guide rodless air cylinder and the side-guide drive motor so that the side guide moves in accordance with the lengths in the width direction of the signatures.

17 Claims, 17 Drawing Sheets

DELIVERY

The entire disclosure of Japanese Patent Application No. 2004-136133 filed on Apr. 30, 2004 and Japanese Patent Application No. 2005-107122 filed on Apr. 4, 2005, including specification, claims, drawings and summary, is incorporated herein by reference in its entirety.

BACKGROUND OF THE INVENTION

1. Field of the Invention

The present invention relates to a delivery in a folding machine of a web-fed rotary press.

2. Description of Related Art

A web-fed rotary press is provided with a folding machine for cutting a web at predetermined lengths, which is dried and cooled after printing, and then folding the cut web in the width direction or the longitudinal direction. The signature which is folded and formed by the folding machine is sent to a delivery, and is transported to a paper delivery belt by rotation of a fan wheel. Thereafter, the signature is delivered from the printing press by this paper delivery belt.

The fan wheel is provided with a number of vanes, and is designed to receive and hold the signature between the vanes, and transfer the signature onto the transporting belt as the fan wheel rotates. Such a fan wheel is designed to restrict the signature in the width direction which is held by the fan wheel by providing a side guide to each side of the fan wheel. Incidentally, since the folding specification such as one time folding, two-time folding or delta folding is selectively employed in the folding machine, the paper width of the signature, which is transported from the folding machine into the delivery, differs for each folding specification.

For this reason, depending on the folding specification, it is necessary to move the side guide in accordance with the length in the width direction of the signature, and a case where the side guide is placed in the fan wheel including a plurality of vanes with predetermined spacing in the width direction of the signature, occurs. For such movement of the side guide at the time of changing the folding specification, a method in which the side guide is temporarily detached and again fixed in a predetermined position, is conventionally adopted. Thus, there have been possibilities that tools are required and that a part is lost. In addition, there is a problem that adjustment of the mounting position of the side guide is troublesome.

A delivery for solving such problems is disclosed in Japanese Patent Application Laid-open No. 2000-86039, for example. In the conventional delivery, the problems are solved by providing, to a side guide, supporting mechanism which allows for movement between a guide position for guiding the signature held in the fan wheel and a retraction position for retraction from the fan wheel at the time of changing the folding specification.

In the above-described conventional delivery, however, although the supporting mechanism allowing for movement of the side guide is provided, since the mechanism is operated manually, the amount of adjustment is different depending on the operators performing the position adjustment of the side guide. In some cases, there is a possibility that a paper jam occurs. On the other hand, in the transport position of the signature transported by the fan wheel, some errors occur in the width direction in response to the speed of the printing press. Especially at the time of starting up the printing press, since the signature is transported at a low speed, the signature has little momentum, lacks stability, and is thus often transported askew. Accordingly, even when the side guide is successfully adjusted in accordance with the width direction of the signature, a glitch that the signature cannot be appropriately guided by the side guide has occurred at the time of low speed operation.

SUMMARY OF THE INVENTION

Accordingly, the present invention is to solve the above-described problem. To that end, the present invention provides a delivery which automatically moves guide members at the time of changing the folding specification.

A delivery according to a first aspect of the present invention to solve the above problems includes:

a fan wheel holding and rotationally transporting a sheet delivered from a printing press;

a pair of side guides restricting the sheet in the width direction which is held in the fan wheel;

side-guide radial-direction moving means for moving at least one side guide between a side-guide guide position for guiding the sheet and a side-guide retraction position for retraction to the outside of the fan wheel in the radial direction thereof;

side-guide width-direction moving means for moving at least one side guide in the width direction of the sheet; and control means for controlling the side-guide radial-direction moving means and the side-guide width-direction moving means in such a manner that the one side guide moves in accordance with the length in the width direction of the sheet.

A delivery according to a second aspect of the present invention to solve the above problems wherein, in the delivery according to the first aspect, the side-guide retraction positions are placed outside the peripheries of the fan wheel when the side guide is moved in the axis direction.

A delivery according to a third aspect of the present invention to solve the above problems wherein, in the delivery according to the first aspect, the side-guide radial-direction moving means and the side-guide width-direction moving means are made as side-guide moving means in which the side-guide width-direction moving means supports the side-guide radial-direction moving means.

A delivery according to a fourth aspect of the present invention to solve the above problems wherein, in the delivery according to the third aspect, the side-guide radial-direction moving means is a rodless air cylinder, and the side-guide width-direction moving means is a motor.

A delivery according to a fifth aspect of the present invention to solve the above problems wherein, in the delivery according to the third aspect, the delivery further includes:

a back guide which is provided between the pair of side guides, and which guides the rear end of the sheet which is held in the fan wheel; and back guide moving means moving the back guide between a back-guide guide position for guiding the sheet and a side-guide retraction position for retraction to the outside of the fan wheel in the radial direction thereof, wherein the side-guide retraction position is placed in such a manner that the side guide can move in the width direction of the sheet.

A delivery according to a sixth aspect of the present invention to solve the above problems wherein, in the delivery according to the fifth aspect, the control means moves the side guide to the side-guide retraction position after moving the back guide to the side-guide retraction position, and the control means moves the back guide to the back-guide guide position after moving the side guide to the side-guide guide position.

A delivery according to a seventh aspect of the present invention to solve the above problems wherein, in the delivery according to the first aspect, the delivery further includes:

a back guide which is provided between the pair of side guides, and which guides the rear end of the sheet which is held in the fan wheel; and back guide moving means moving the back guide between a back-guide guide position for guiding the sheet and a side-guide retraction position for retraction to the outside of the fan wheel in the radial direction thereof, wherein the control means moves the side guide to the side-guide retraction position after moving the back guide to the side-guide retraction position, and then moves the side guide to the side-guide guide position.

A delivery according to an eighth aspect of the present invention to solve the above problems wherein, in the delivery according to the fifth aspect, the back guide includes a plurality of back guide members in the width direction of the sheet, and the plurality of the back guide members are individually provided with the back guide moving means.

A delivery according to a ninth aspect of the present invention to solve the above problems wherein, in the delivery according to the eighth aspect, one back guide member out of the plurality of back guide members is fixed to a guide block, and another back guide member is inserted into the guide block and the forward movement thereof is restricted by the guide block.

A delivery according to a 10th aspect of the present invention to solve the above problems wherein, in the delivery according to the ninth aspect, the plurality of back guide members are moved between the back-guide guide position and the side-guide retraction position by use of the movement of the guide block.

A delivery according to an 11th aspect of the present invention to solve the above problems wherein, in the delivery according to the ninth aspect, the other side guide is immovably supported and is fixed near the back guide member.

A delivery according to a 12th aspect of the present invention to solve the above problems wherein, in the delivery according to the first aspect, the fan wheel includes a plurality of fan wheel members in the width direction of the sheet, and at least one fan wheel member out of the plurality of fan wheel members is supported freely movably in the width direction of the sheet.

A delivery according to a 13th aspect of the present invention to solve the above problems wherein, in the delivery according to the 12th aspect, fan wheel moving means moving the plurality of fan wheel members in the width direction of the sheet is provided.

A delivery according to a 14th aspect of the present invention to solve the above problems wherein, in the delivery according to the fifth aspect, the control means moves the back guide to the side-guide retraction position, moves the side guide to the side-guide retraction position, moves the fan wheel to a position corresponding to the sheet, moves the side guide to the side-guide guide position, and then moves the back guide to the back-guide guide position.

DETAILED DESCRIPTION OF THE INVENTION

An embodiment of a delivery according to the present invention will be explained in detail below by use of drawings.

Figure 1:
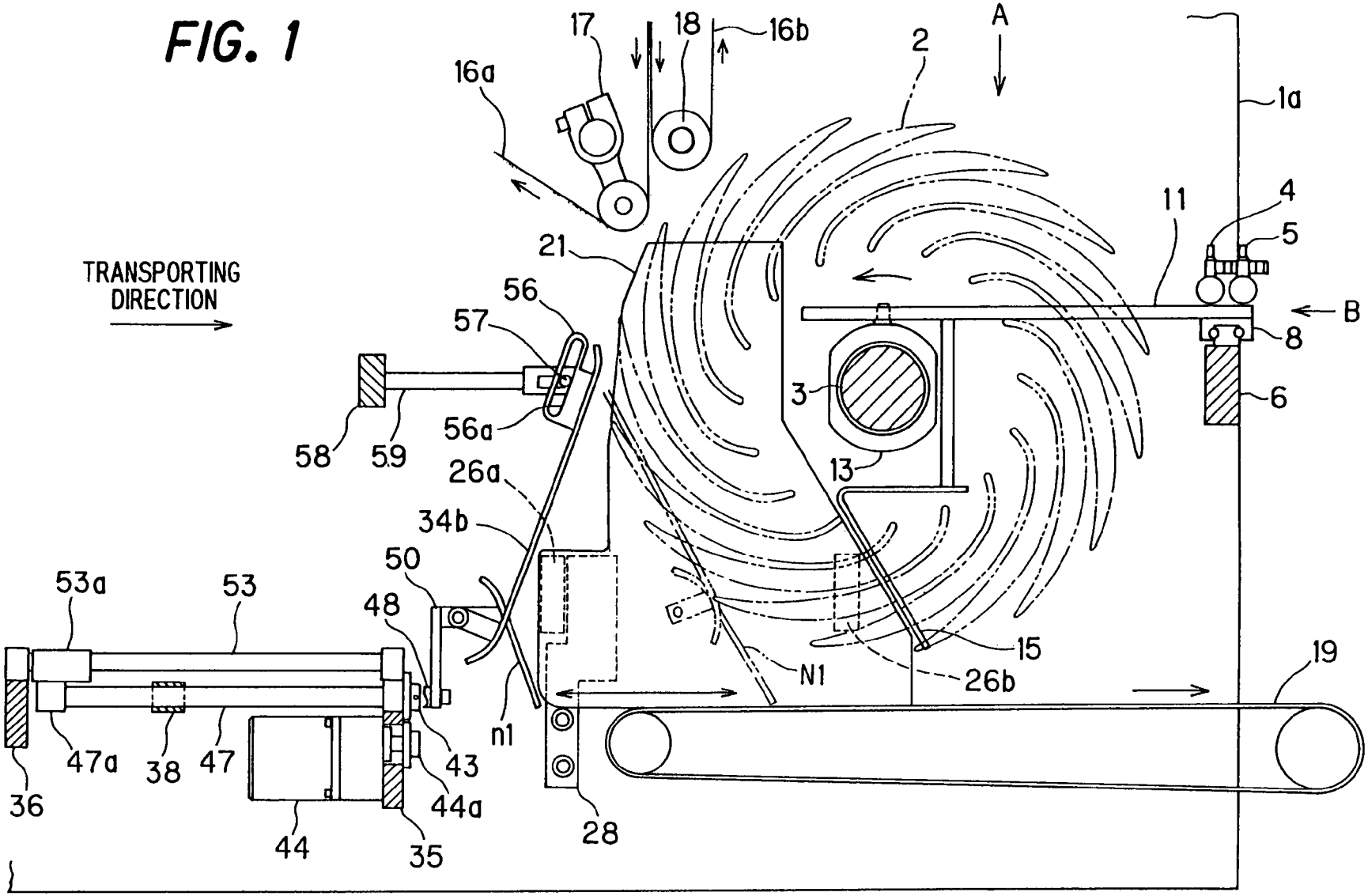
FIG. 1 is a side view of a delivery according to an embodiment of the present invention.
Figure 2:
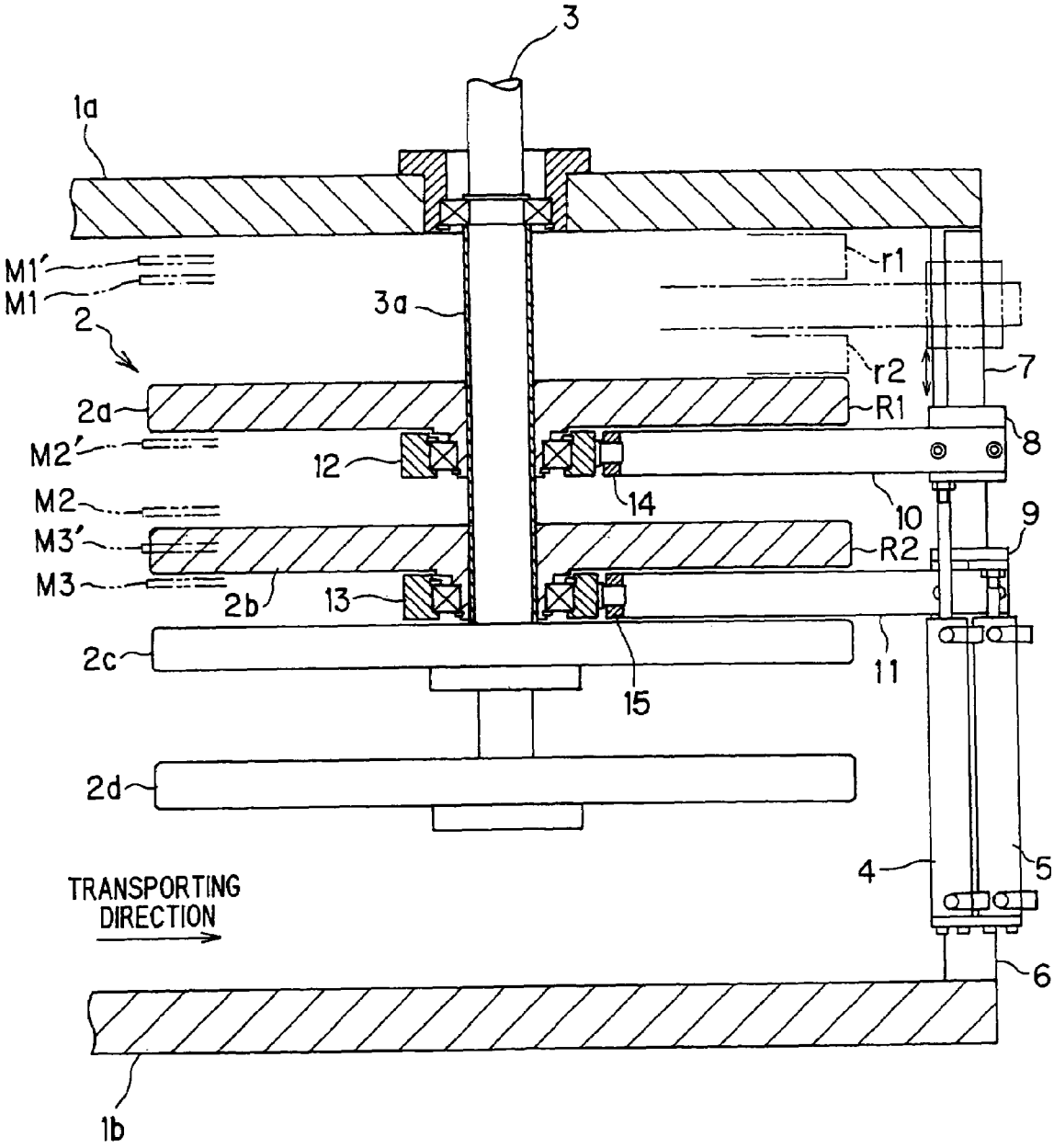
FIG. 2 is a view on arrow A of FIG. 1.
Figure 3:
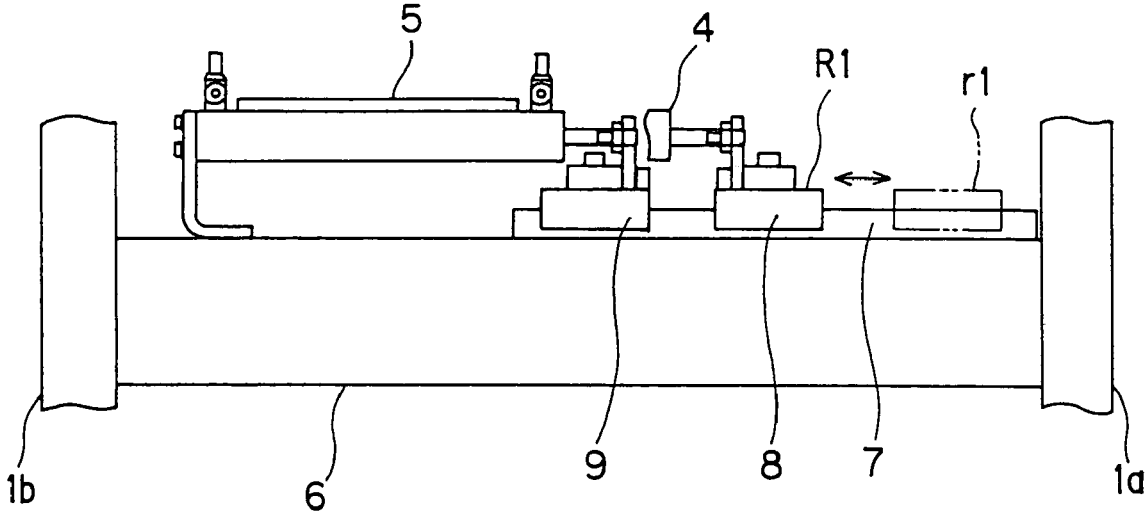
FIG. 3 is a view on arrow B of FIG. 1.
Figure 4:
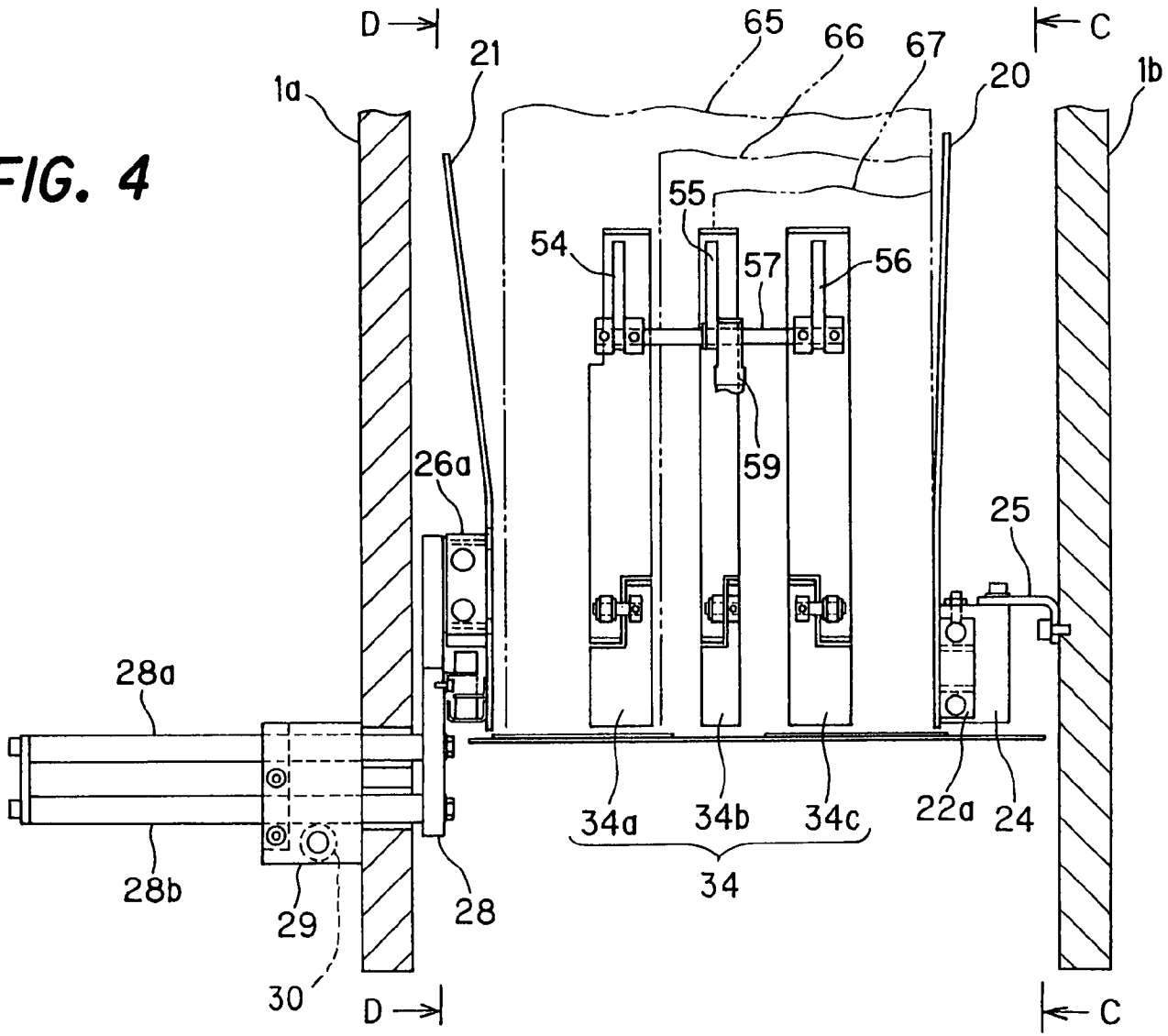
FIG. 4 is a front view of the delivery according to the embodiment of the present invention.
Figure 5:
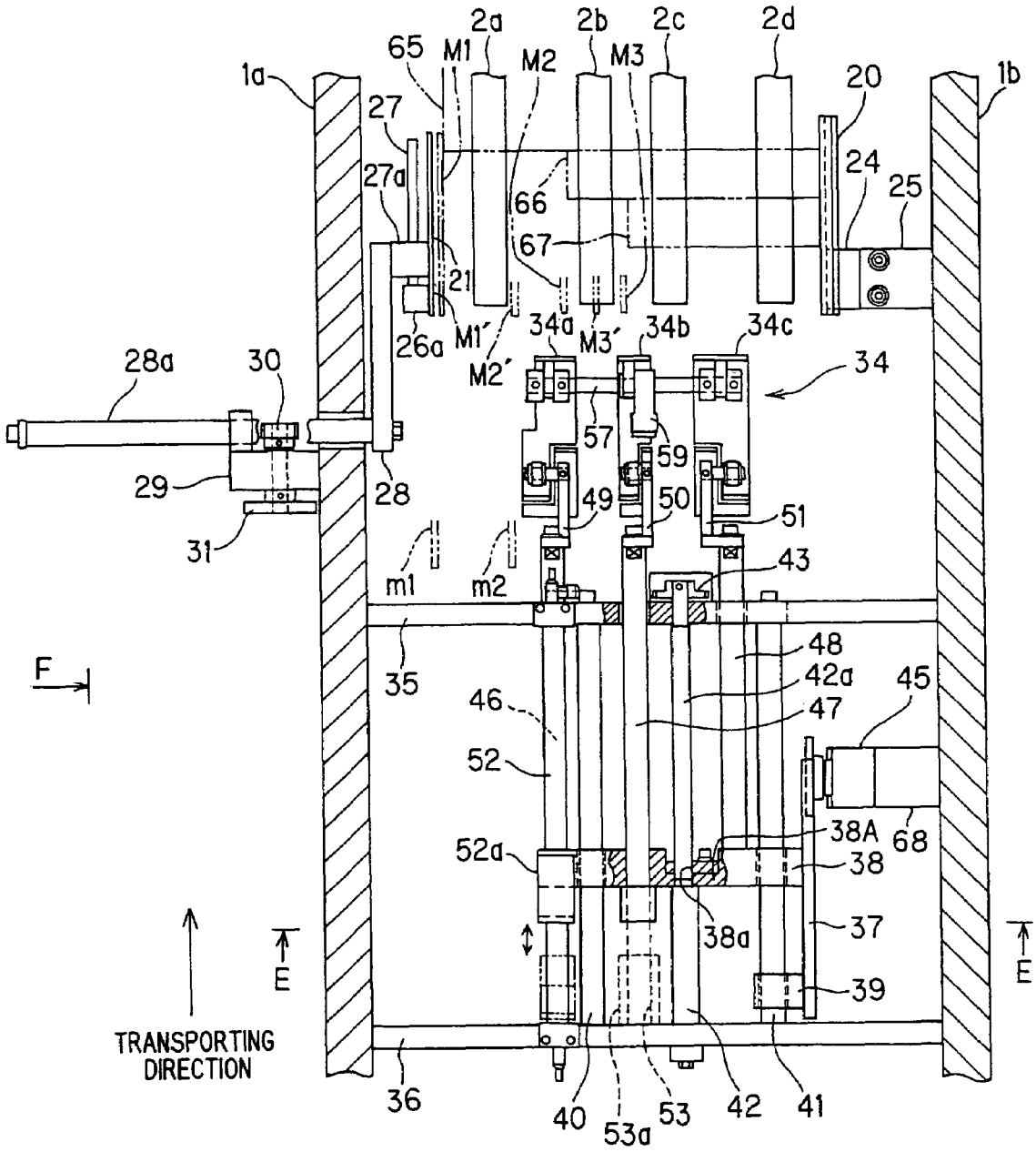
FIG. 5 is a plan view of the delivery according to the embodiment of the present invention.
Figure 6:
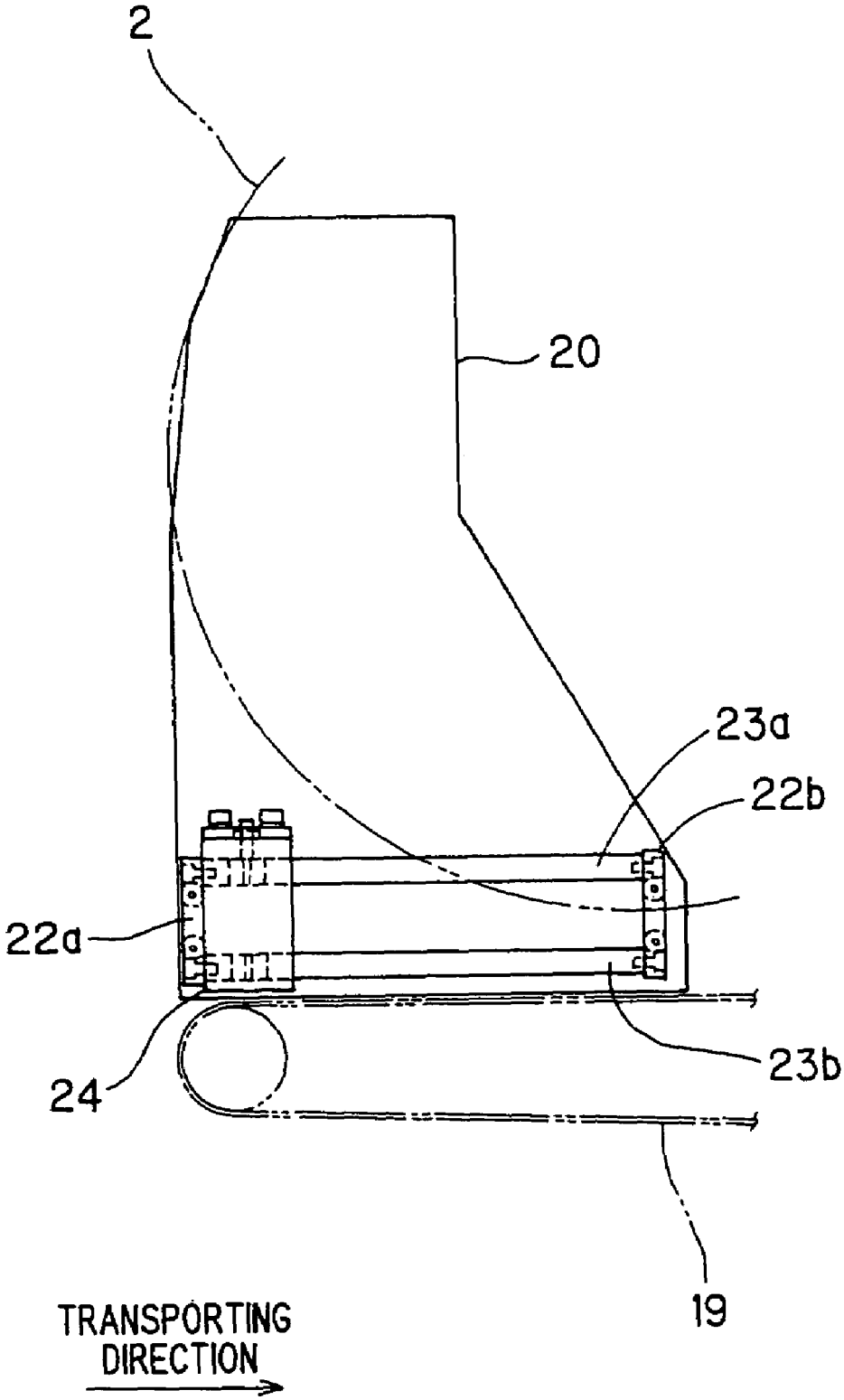
FIG. 6 is a view on arrows C-C of FIG. 4.
Figure 7:
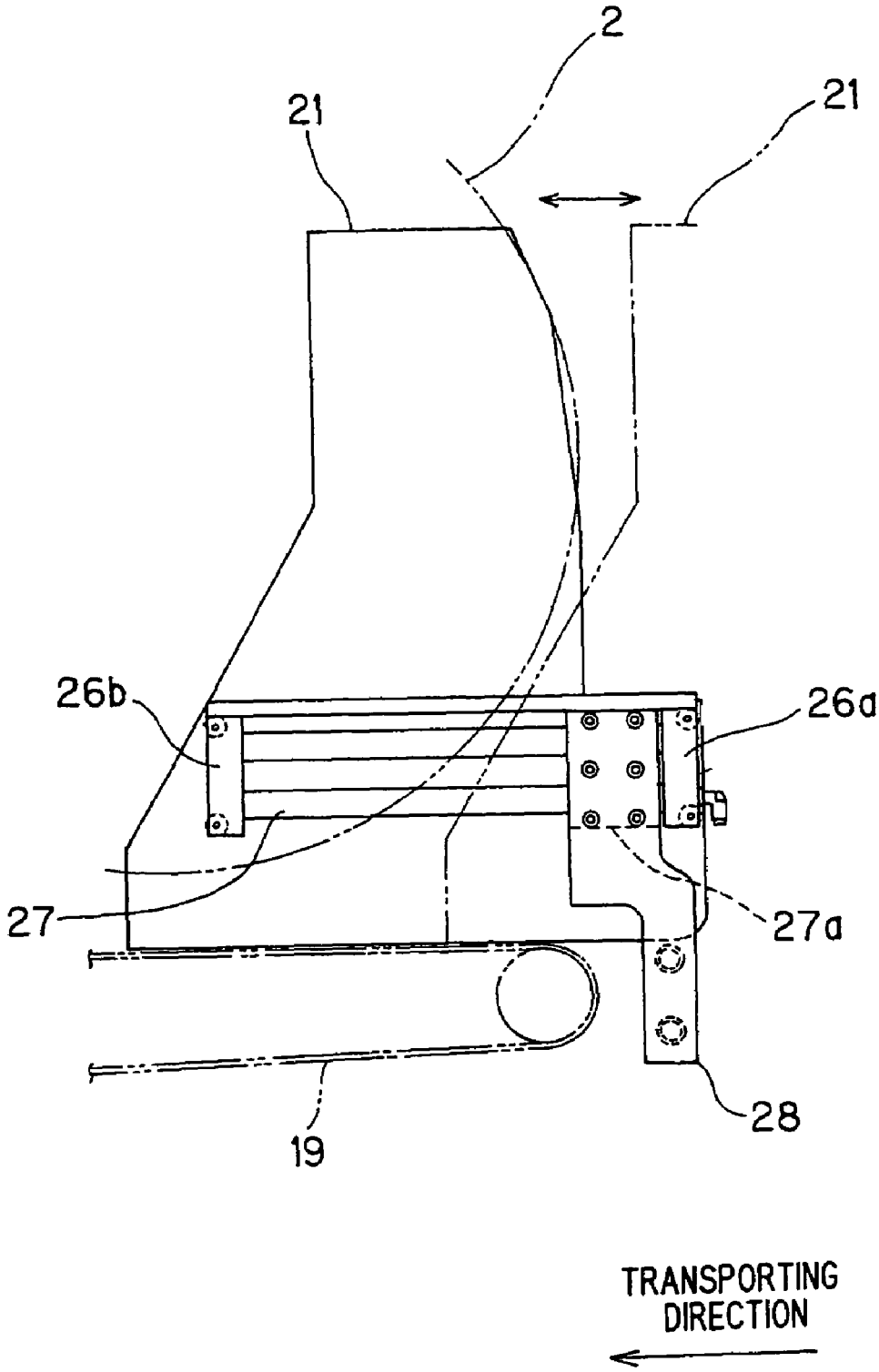
FIG. 7 is a view on arrows D-D of FIG. 4.
Figure 8:
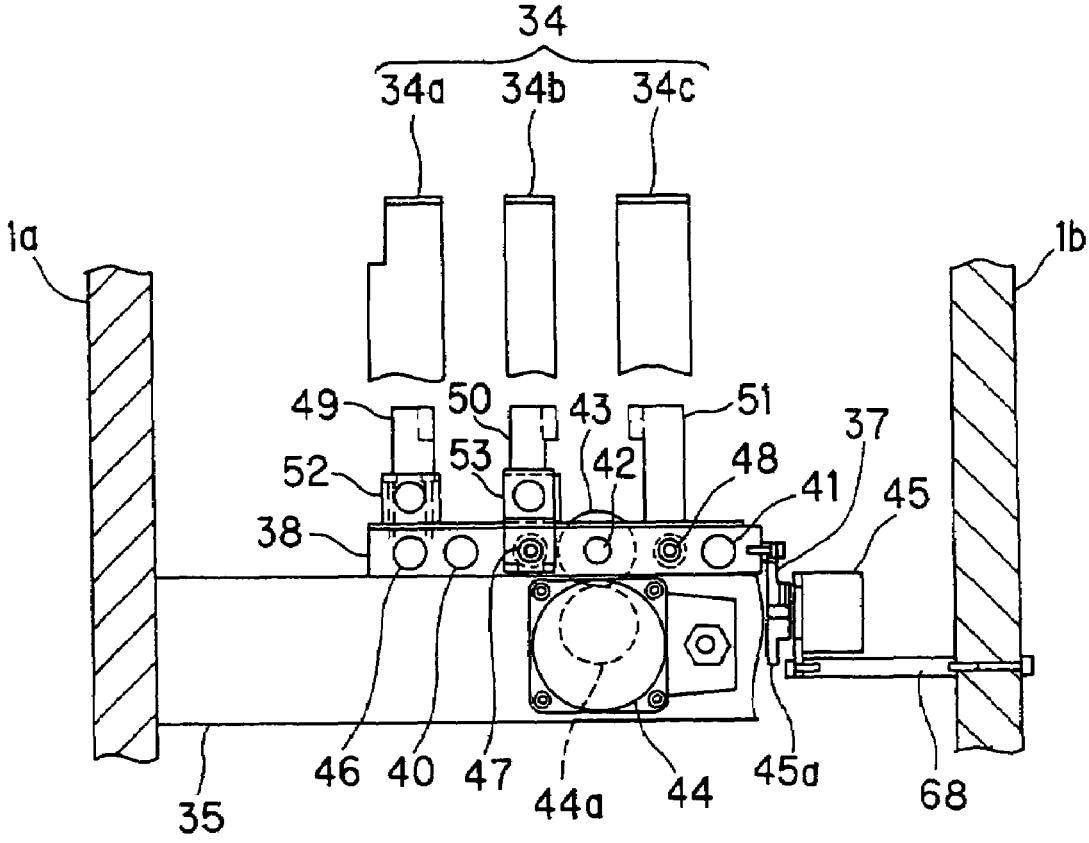
FIG. 8 is a sectional view on arrows E-E of FIG. 5.
Figure 9:
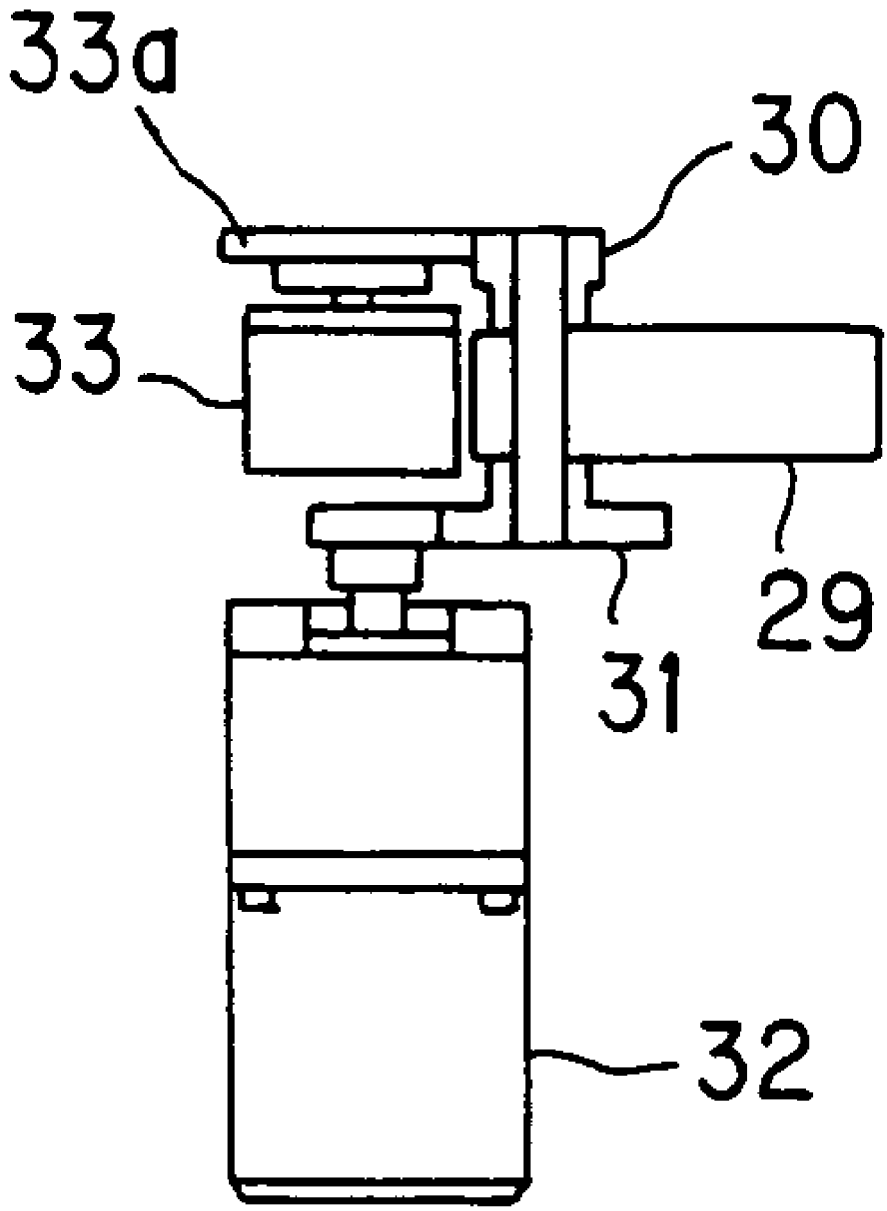
FIG. 9 is a sectional view on arrow F of FIG. 5.
Figure 10:
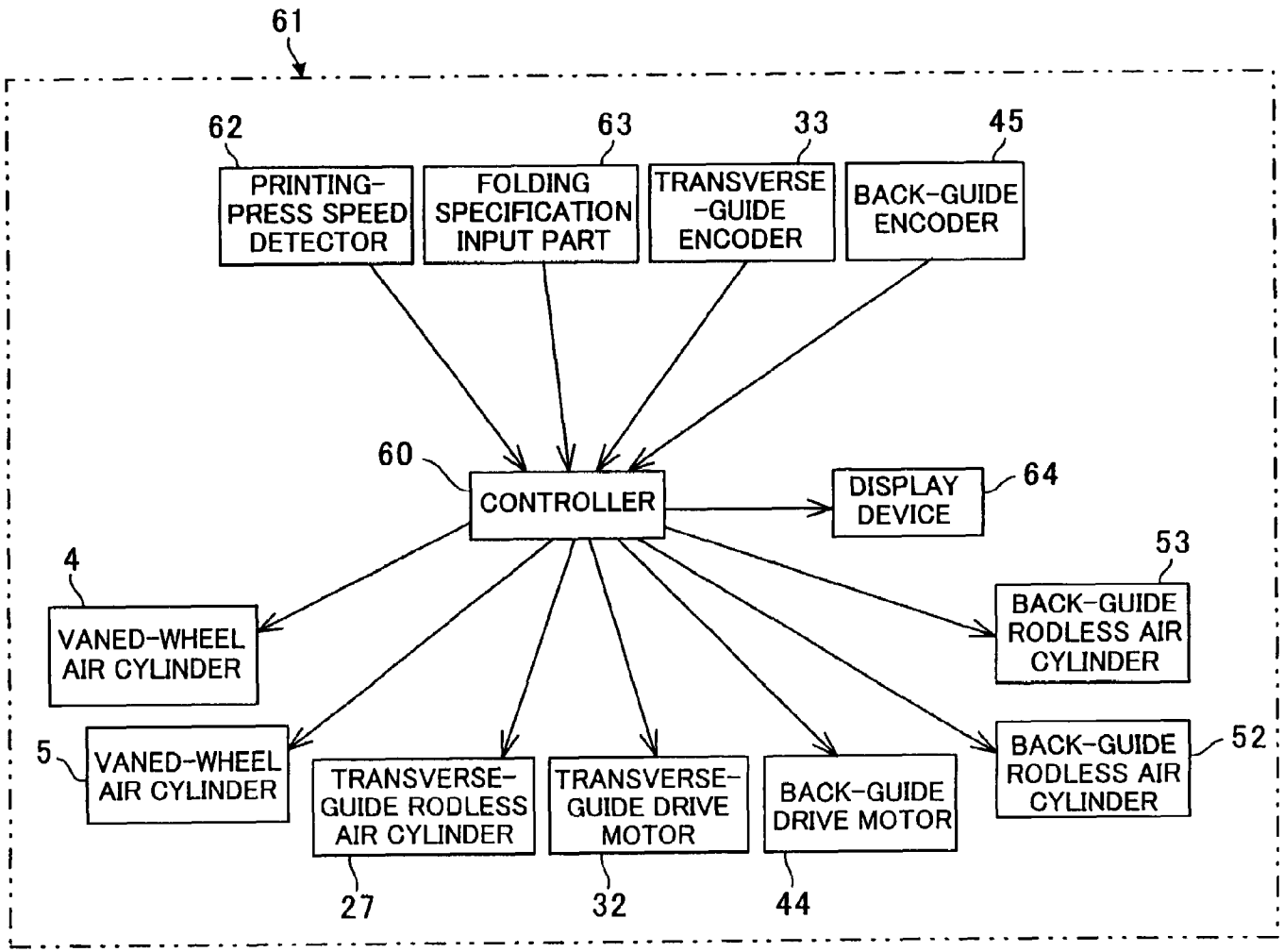
FIG. 10 is a block diagram according to an embodiment of the present invention.
Figure 11:
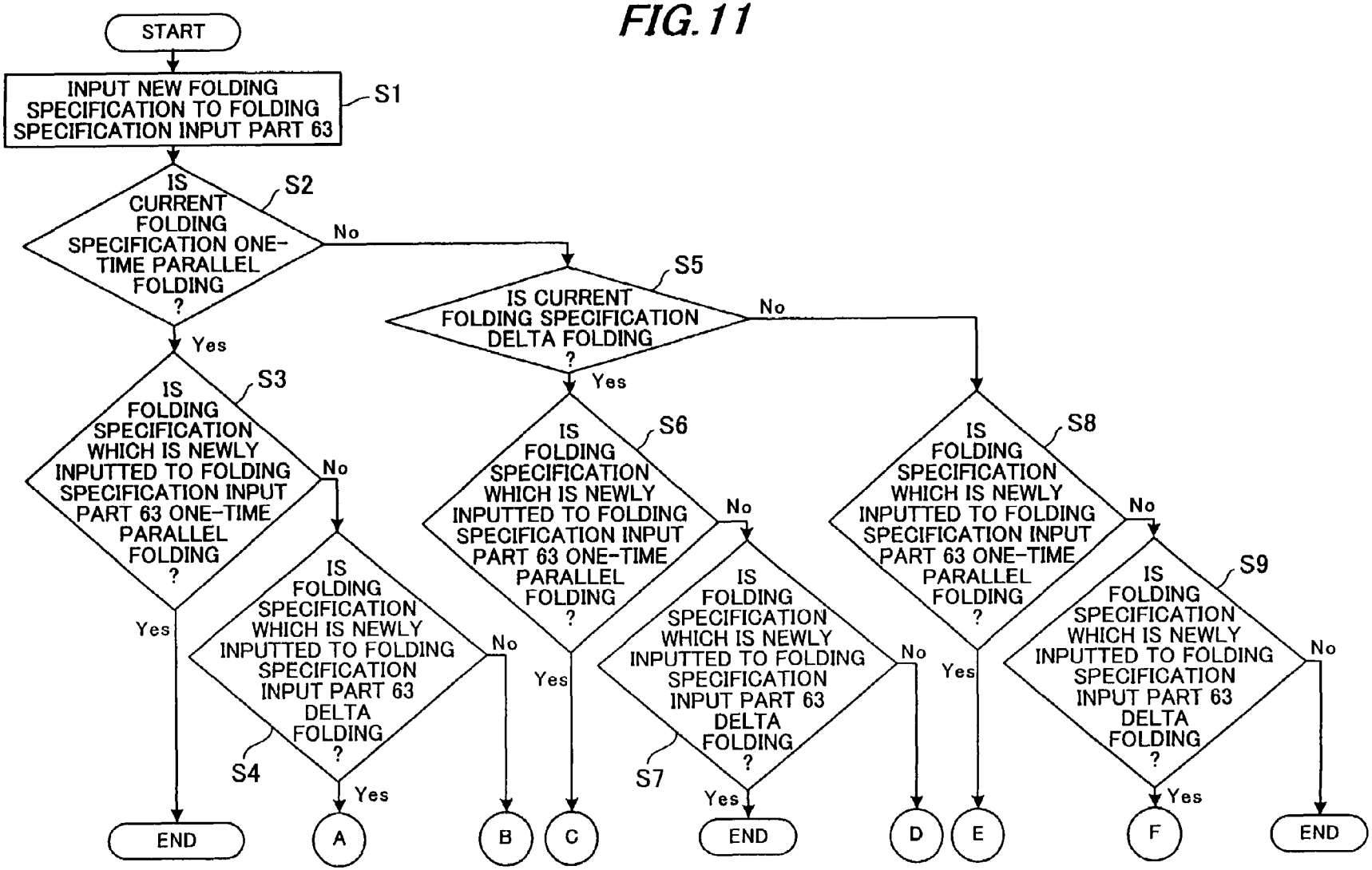
FIG. 11 is a flowchart showing a discrimination process at the time of changing the folding specification.
Figure 12:
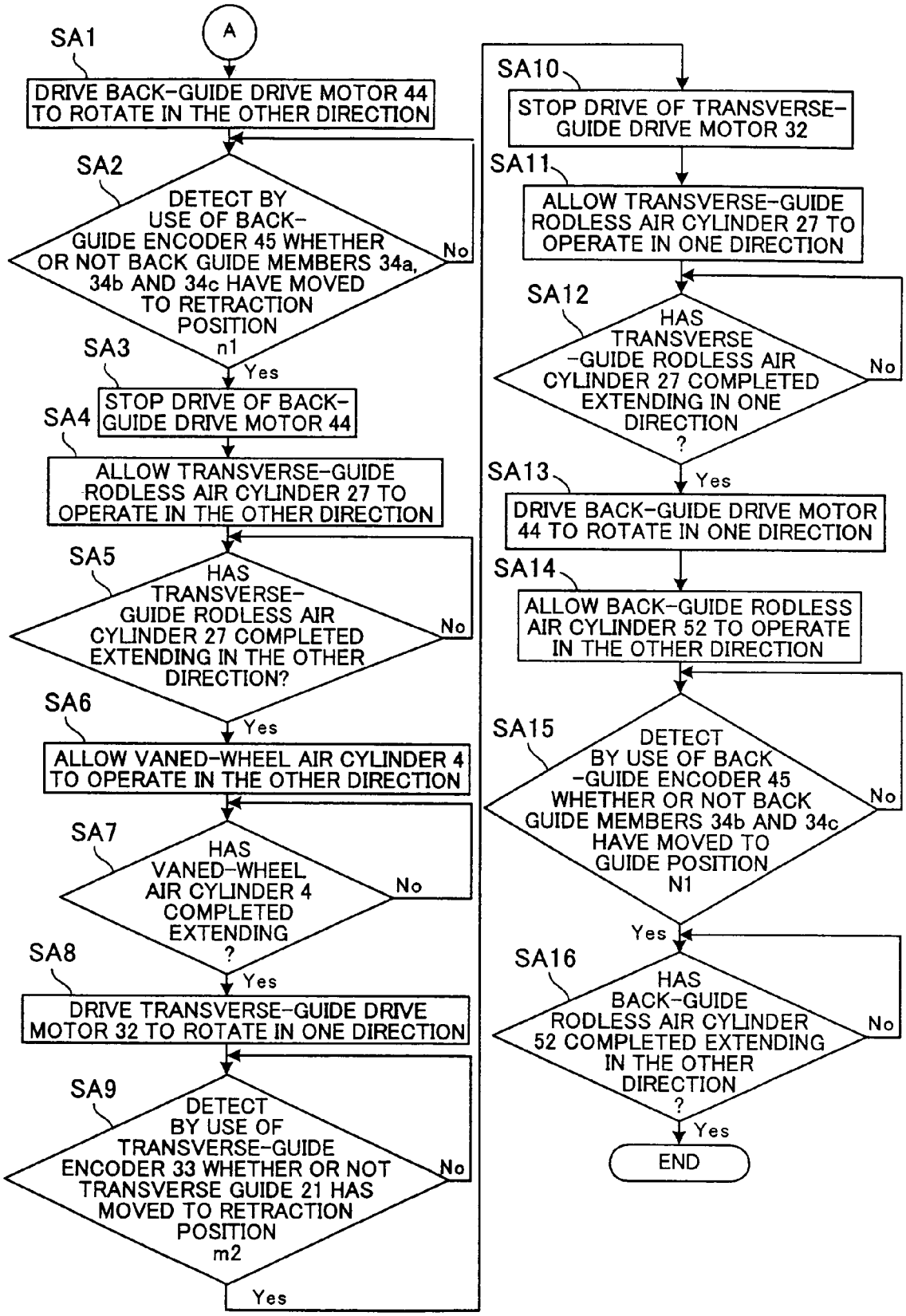
FIG. 12 is a flowchart showing a process at the time of changing the folding specification from the one-time parallel folding to the delta folding.
Figure 13:
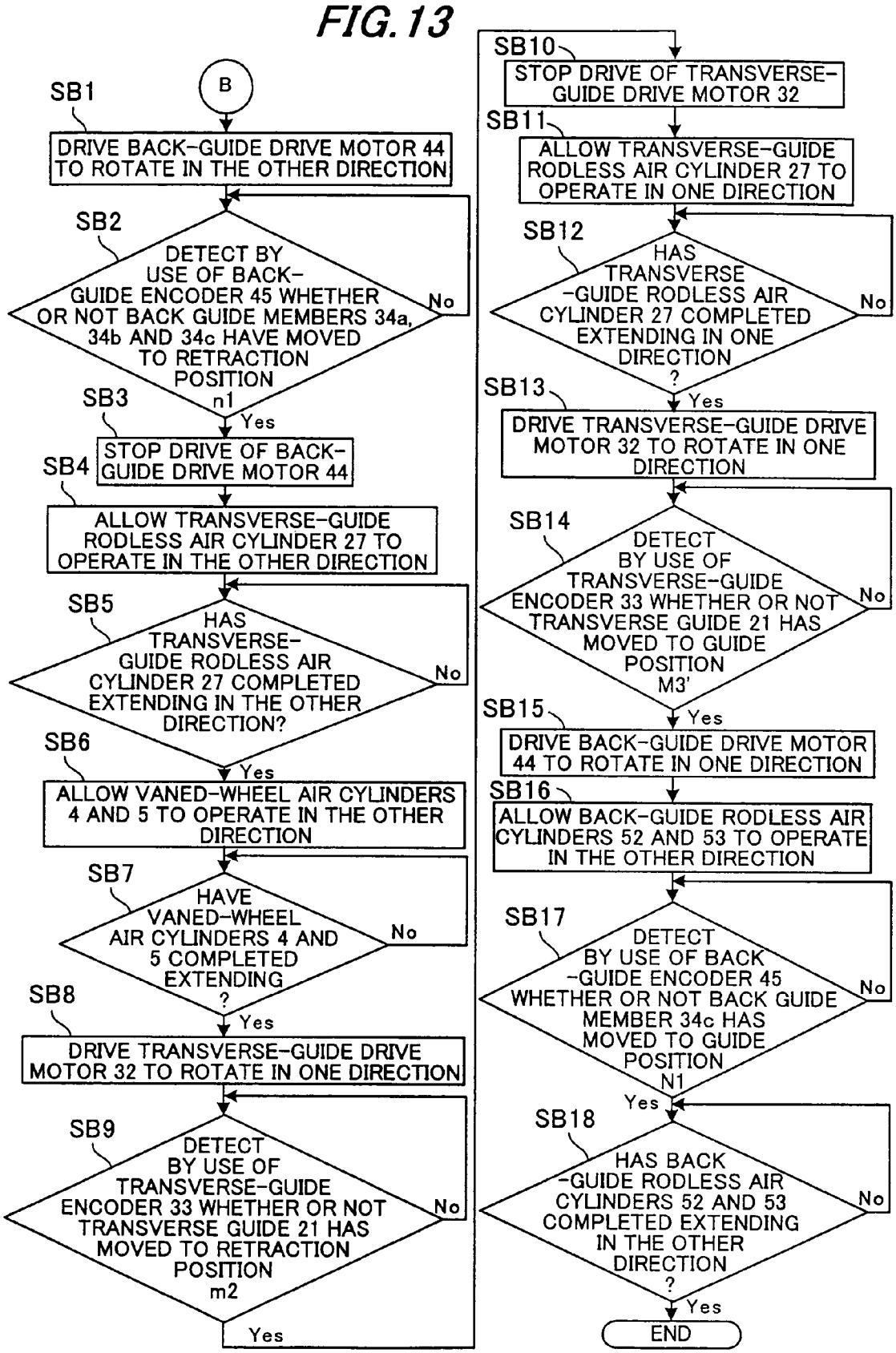
FIG. 13 is a flowchart showing a process at the time of changing the folding specification from the one-time parallel folding to the two-time parallel folding.
Figure 14:
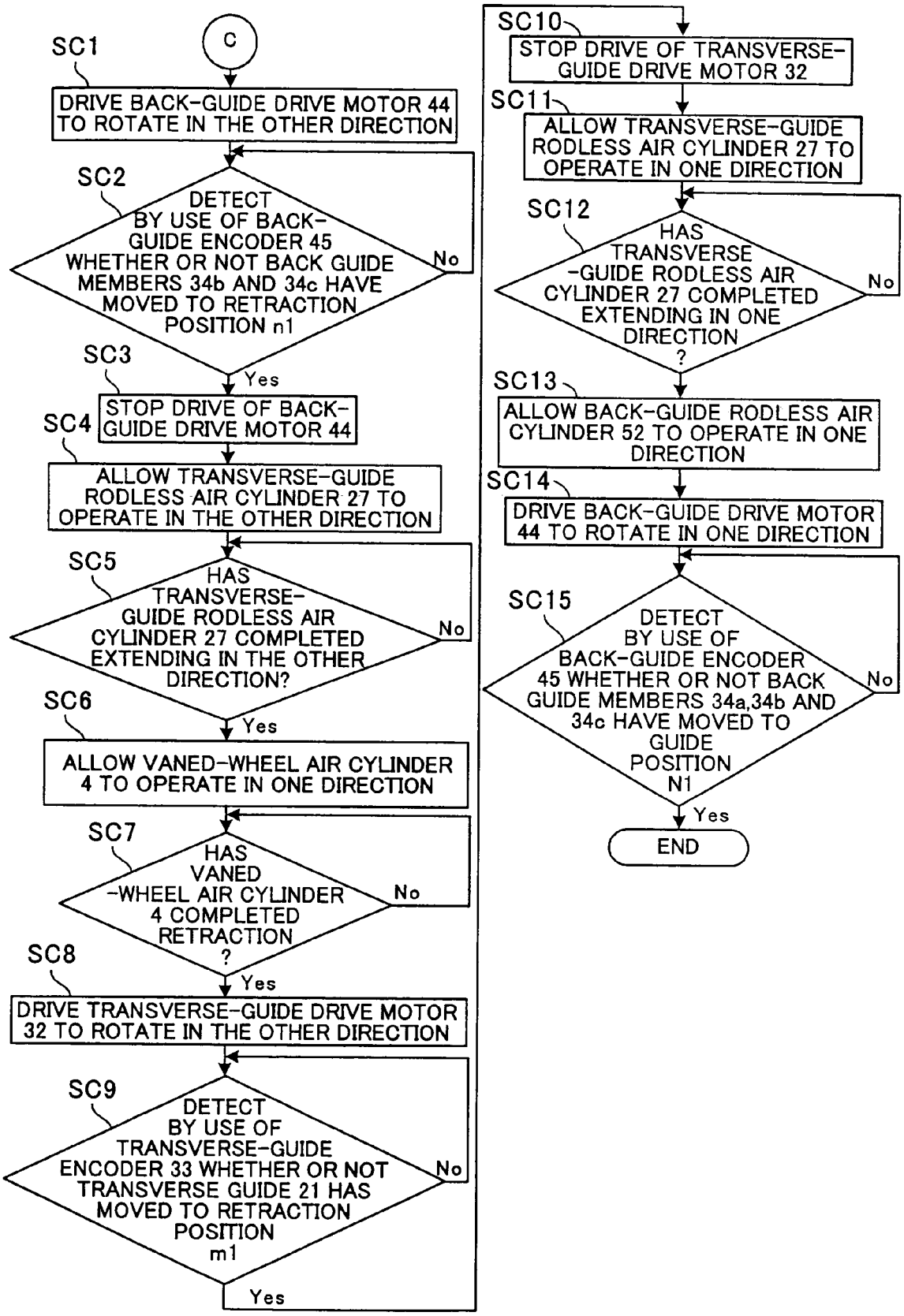
FIG. 14 is a flowchart showing a process at the time of changing the folding specification from the delta folding to the one-time parallel folding.
Figure 15:
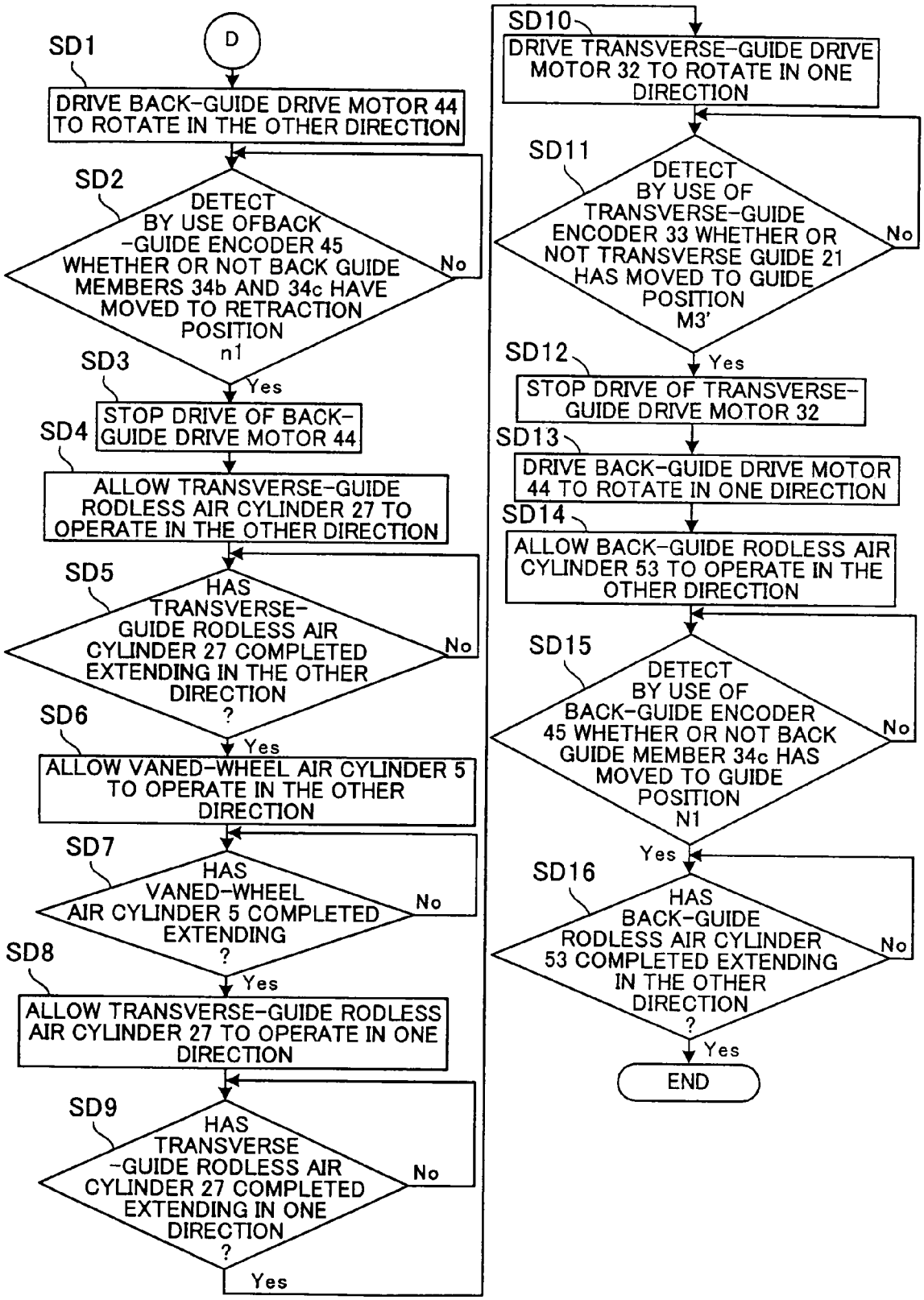
FIG. 15 is a flowchart showing a process at the time of changing the folding specification from the delta folding to the two-time parallel folding.
Figure 16:
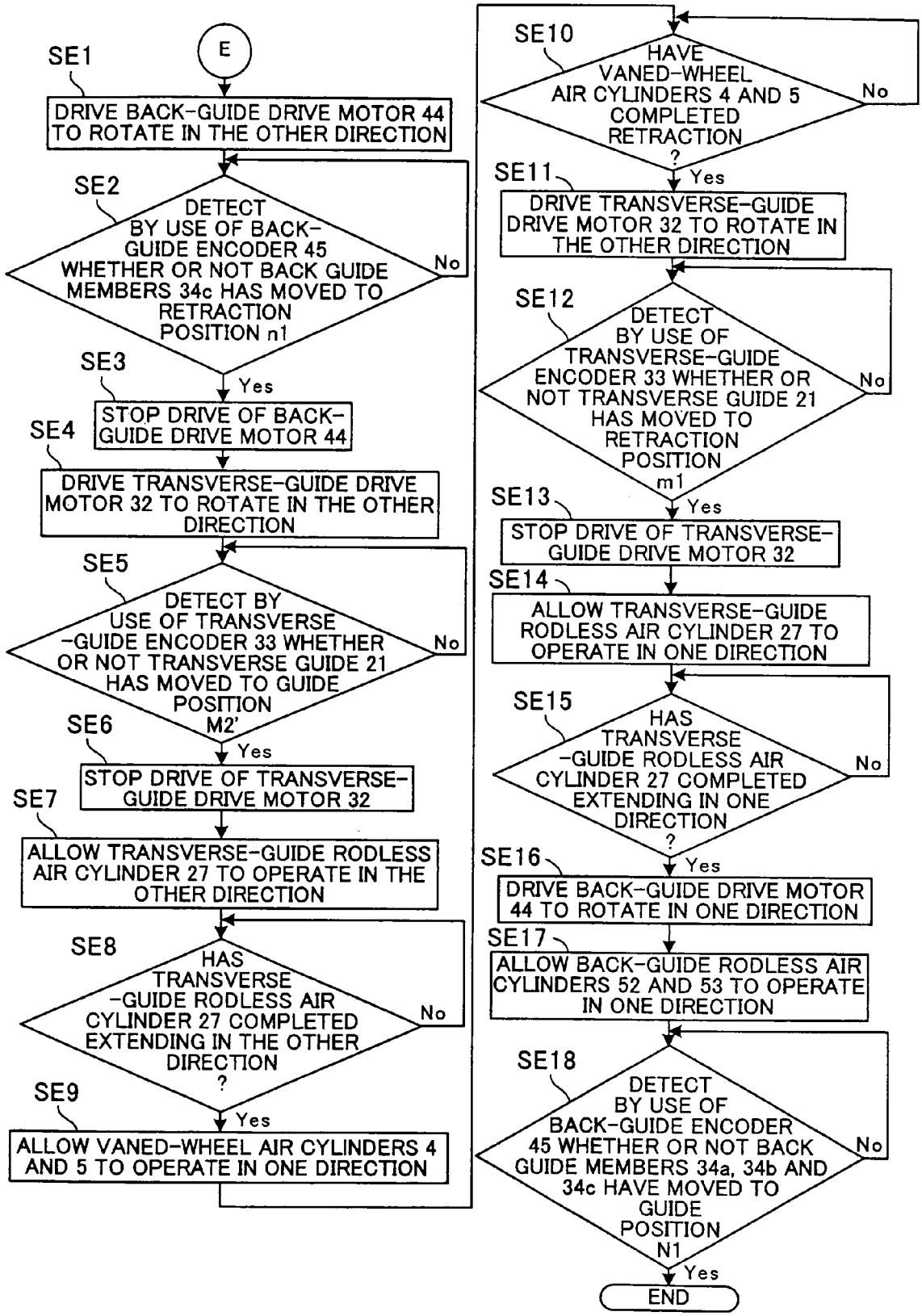
FIG. 16 is a flowchart showing a process at the time of changing the folding specification from the two-time parallel folding to the one-time parallel folding.
Figure 17:
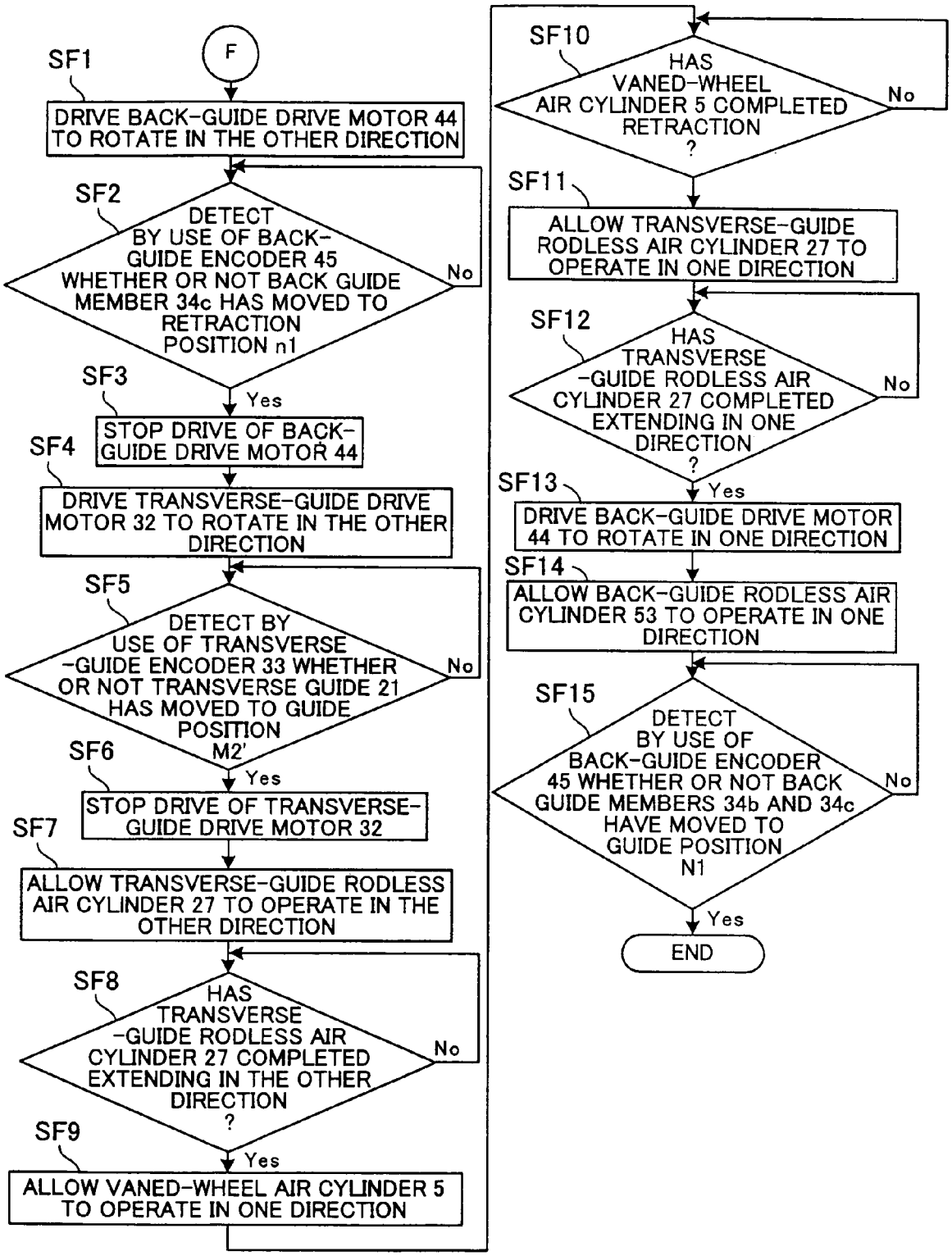
FIG. 17 is a flowchart showing a process at the time of changing the folding specification from the two-time parallel folding to the delta folding.

FIG. 1 is a side view of the delivery according to the embodiment of the present invention. FIG. 2 is a view on arrow A of FIG. 1. FIG. 3 is a view on arrow B of FIG. 1. FIG. 4 is a front view of the delivery according to the embodiment of the present invention. FIG. 5 is a plan view of the delivery according to the embodiment of the present invention. FIG. 6 is a view on arrows C-C of FIG. 4. FIG. 7 is a view on arrows D-D of FIG. 4. FIG. 8 is a sectional view on arrows E-E of FIG. 5. FIG. 9 is a view on arrow F of FIG. 5. FIG. 10 is a block diagram according to an embodiment of the present invention. FIG. 11 is a flowchart showing a discrimination process at the time of changing the folding specification. FIG. 12 is a flowchart showing a process at the time of changing the folding specification from the one-time parallel folding to the delta folding. FIG. 13 is a flowchart showing a process at the time of changing the folding specification from the one-time parallel folding to the two-time parallel folding. FIG. 14 is a flowchart showing a process at the time of changing the folding specification from the delta folding to the one-time parallel folding. FIG. 15 is a flowchart showing a process at the time of changing the folding specification from the delta folding to the two-time parallel folding. FIG. 16 is a flowchart showing a process at the time of changing the folding specification from the two-time parallel folding to the one-time parallel folding. FIG. 17 is a flowchart showing a process at the time of changing the folding specification from the two-time parallel folding to the delta folding.

As shown in the drawings, a fan wheel 2 is pivotally supported between a pair of frames 1*a* and 1*b* of the delivery. An arrow in FIG. 1 indicates the rotation direction of the fan wheel 2. With further reference to FIGS. 2 and 5, the fan wheel 2 includes four fan wheel members 2*a*, 2*b*, 2*c* and 2*d*, and these are supported on a supporting shaft 3 with predetermined spacing. Among these, the fan wheel members 2*a* and 2*b* are splined on a spline portion 3*a* of the supporting shaft 3 to be able to rotate with the supporting shaft 3, and are movable in the axis direction of the supporting shaft 3. Moreover, the fan wheel members 2*a* and 2*b* are connected to fan-wheel air cylinders 4 and 5 provided as fan wheel moving means.

The fan-wheel air cylinders 4 and 5 are attached to a supporting plate 6, which is disposed between the frames 1*a* and 1*b*. Sliding members 8 and 9, which slide on a rail 7 attached on the supporting plate 6, are attached to one ends of the air cylinders 4 and 5. The sliding members 8 and 9 support the fan wheel members 2*a* and 2*b* via supporting members 10 and 11. The fan wheel members 2*a* and 2*b* are pivotally supported by bearings 12 and 13 attached to one ends of the supporting members 10 and 11. Moreover, strippers 14 and 15 are attached to the supporting members 10 and 11.

Above the fan wheel 2, a pair of transporting belts 16*a* and 16*b* for transporting a signature (the signature 65, 66 or 67 described later) provided as a sheet are looped over roller members 17 and 18. The signature which has been transported is ejected from between the roller members 17 and 18, and held by the fan wheel 2. On the other hand, below the fan wheel 2, provided is a paper delivery belt 19 for receiving the signature which is discharged from the fan wheel 2 and then delivering the signature to a predetermined position. Arrows in FIG. 1 indicate the transporting directions of the transporting belts 16*a* and 16*b* and the paper delivery belt 19.

In addition, referring to FIGS. 4, 6 and 7, a pair of plate-shaped side guides 20 and 21 for restricting the signature in the width direction, which is temporarily held by the fan wheel 2, are disposed inside the frames 1*a* and 1*b*, the side guides 20 and 21 being placed on both sides of the fan wheel 2.

A pair of brackets 22*a* and 22*b* are attached to the back face of the side guide 20, and slide rods 23*a* and 23*b* are supported by the upper and lower portions of the brackets 22*a* and 22*b*. A supporting block 24 slidably supports the slide rods 23*a* and 23*b*, and is supported by the frame 1*b* via an arm 25.

On the other hand, a pair of brackets 26*a* and 26*b* are attached to the back face of the side guide 21, and a side-guide rodless air cylinder 27 provided as side-guide radial-direction moving means is supported between the brackets 26*a* and 26*b*. A supporting plate 28 is supported by a moving block 27*a* of the side-guide rodless air cylinder 27, and supports moving rods 28*a* and 28*b*, which are disposed perpendicularly to the side-guide rodless air cylinder 27. The moving rods 28*a* and 28*b* are supported by a supporting block 29 outside the frame 1*a*. The moving rod 28*b* has a rack shape formed, and the rack and an end of a gear 30 engage with each other. The other end of the gear 30 is connected with an end of a gear 31, and engages with a gear 33*a* of a side-guide encoder 33. A side-guide drive motor 32 provided as side-guide width-direction moving means is attached to the gear 31. (FIGS. 5 and 9)

A back guide 34 for restricting the signature in the longitudinal direction (the radial direction of the fan wheel 2) which is temporarily held by the fan wheel 2 is disposed inside the side guides 20 and 21. The back guide 34 includes three back guide members 34*a*, 34*b* and 34*c*. The back guide members 34*a* to 34*c* are supported with predetermined spacing in the width direction of the signature, and are disposed between the fan wheel members 2*a*, 2*b*, 2*c* and 2*d*, respectively.

On the back face side of the back guide 34, placed are supporting plates 35 and 36, (FIGS. 1 and 8) which are disposed between the frames 1*a* and 1*b*. Between the supporting plates 35 and 36, guide blocks 38 and 39 supporting a rack 37, which engages with a gear 45*a* of a below-described back-guide encoder 45, are placed, and a rotation rod 42 and guide rods 40 and 41 supporting these members are installed. (FIG. 5)

The guide rod 40 is, at both ends thereof, fixed to the supporting plates 35 and 36, and disposed in a state where the guide rod 40 penetrates the guide block 38. The guide rod 41 is, at both ends thereof, fixed to the supporting plates 35 and 36, and disposed in a state where the guide rod 41 penetrates the guide blocks 38 and 39. The rotation rod 42 is, at both ends thereof, pivotally supported by the supporting plates 35 and 36. Here, an external thread portion 42*a* is formed in the rotation rod 42, and engages with an internal thread portion 38*a* formed in a block 38A which is fixed to the guide block 38. Moreover, a gear 43 is provided to an end of the rotation rod 42. (FIG. 8)

Below the rotation rod 42, a back-guide drive motor 44 provided as back-guide moving means, which is supported by the supporting plate 35, is placed, and a gear 44*a* of the back-guide drive motor 44 and the gear 43 engages with each other. The back-guide encoder 45 is supported by a bracket 68 which is supported by the frame 1*b*, and the gear 45*a* of the back-guide encoder 45 and the rack 37 engage with each other.

Next, between the supporting plate 35 and the guide block 38, moving rods 46 and 47 and a fixed rod 48 are disposed. The moving rods 46 and 47 penetrate the supporting plate 35 and the guide block 38. End portions 46*a* and 47*a* located outside the guide block 38 are formed on one ends of the moving rods 46 and 47, and connection members 49 and 50 are supported by the other ends thereof. One end of the fixed rod 48 penetrates the supporting plate 35 and is fixed to the guide block 38, and the other end thereof is supported by a connection member 51. The moving rods 46 and 47 and the fixed rod 48 support the back guide members 34*a*, 34*b* and 34*c* via the connection members 49, 50 and 51. Each of one ends of the connection members 49, 50 and 51 forks and is swingable, so that the angle thereof can be changed.

Back-guide rodless air cylinders 52 and 53 provided as back-guide moving means, which are supported on the supporting plates 35 and 36 at both ends thereof, are disposed above the moving rods 46 and 47. The end portions 46*a* and 47*a* of the moving rods 46 and 47 are fixed to the bottom of moving blocks 52*a* and 53*a* of the back-guide rodless air cylinders 52 and 53.

Moreover, supporting members 54, 55 and 56 are installed on the back-side upper portions of the back guide members 34*a*, 34*b* and 34*c*, respectively. A supporting shaft 57 is placed in elongated slots 54*a*, 55*a* and 56*a* opening in the supporting members 54, 55 and 56. An arm 59 extended from a supporting plate 58 supports the supporting shaft 57.

Accordingly, with the structure described above, sliding members 8 and 9 slide on the rail 7 as the fan-wheel air cylinders 4 and 5 expand and contract, and the supporting members 10 and 11 slide with this motion, so that the fan wheel members 2*a* and 2*b* can move in the axis direction of the supporting shaft 3, that is, in the width direction of the signature. (FIG. 2)

The side guide 20 is freely slidably supported by the supporting block 24, which is supported by the frame 1*b*, and is thereby movable in the radial direction of the fan wheel 2. On the other hand, the side guide 21 is movable in the radial direction of the fan wheel 2 by means of the side-guide rodless air cylinder 27, and is movable in the width direction of the signature by the forward and reverse rotations of the side-guide drive motor 32. In addition, with the side-guide encoder 33, it is possible to sense the position of the side guide 21 in the width direction of the signature from the rotational position of the side-guide drive motor 32. (FIGS. 4, 6 and 9).

As for the back guide members 34*a*, 34*b* and 34*c*, in the case of moving the back guide members 34*a*, 34*b* and 34*c* toward the fan wheel 2, for example, first, the back-guide drive motor 44 is allowed to rotate, whereby the rotation rod 42 is rotated. The rotation of the rotation rod 42 allows the rack 37 and the guide blocks 38 and 39 to move toward the fan wheel 2, and allows the fixed rod 48 to move. At the same time, since air is fed to the back-guide rodless air cylinders 52 and 53, and the moving blocks 52*a* and 53*a* and the end portions 46*a* and 47*a* of the moving rods 46 and 47 are pressed against the guide block 38, these members also move toward the fan wheel 2.

When the guide block 38 stops in a predetermined position in a state where the end portions 46*a* and 47*a* of the moving blocks 46 and 47 are in contact with the guide block 38, the movement of the moving blocks 52*a* and 53*a* are restricted. Thus, the moving rods 46 and 47 and the fixed rod 48 are placed in the same position, so that the back guide members 34*a*, 34*b* and 34*c* are also placed in the same position. It is designed to be able to sense the position of the back guide members 34*a*, 34*b* and 34*c* at this time by use of the movement of the rack 37 via the gear 45*a* engaging with the rack 37 and the back-guide encoder 45 coupled with the gear 45*a*. (FIG. 8)

Under the above described state, in the case of retracting, from the fan wheel 2, only the back guide members 34*a* and 34*b*, this is made possible by feeding air to the back-guide rodless air cylinders 52 and 53 to move the moving blocks 52*a* and 53*a* and the end portions 46*a* and 47*a* of the moving rods 46 and 47 in the direction of the retraction from the fan wheel 2. Similarly, it is also possible to move only the back guide member 34*a*.

In the case of retracting the back guide members 34*a*, 34*b* and 34*c* from the fan wheel 2, since it is merely the reverse operation of the case of moving the back guide members 34*a*, 34*b* and 34*c* toward the fan wheel 2, the description thereof is omitted.

FIG. 10 is a block diagram showing the configuration of a printing press provided with the delivery according to the present embodiment. As shown in FIG. 10, a printing press 61 includes a controller 60. The controller 60 is connected with the fan-wheel air cylinders 4 and 5; the side-guide rodless cylinder 27; the side-guide drive motor 32; the side-guide encoder 33; the back-guide drive motor 44; the back-guide encoder 45; the back-guide rodless air cylinders 52 and 53; a printing-press speed detector 62; a folding specification input part 63; and a display device 64.

When a folding specification is inputted in the folding specification input part 63 by an operator, on the basis of the signal, the controller 60 performs control sequentially so as to drive the side-guide drive motor 32 and the back-guide drive motor 44, and feed air to the air cylinders 4 and 5, the side-guide rodless cylinder 27, and the back-guide rodless air cylinders 52 and 53. Thus, the fan wheel 2, the side guide 21 and the back guide 34 are moved to predetermined positions. At this time, the positions of the side guide 21 and the back guide 34 are sensed by the side-guide encoder 33 and the back-guide encoder 45, respectively, and an operator can view the positions on the display device 64 such as a display. Moreover, on the basis of the signal from the printing-press speed detector 62, the controller 60 moves the side guide 21 placed in a guide position for a signature in the width direction of the signature in response to the drive speed of the printing press 61, and suitably guides the signature.

Next, a description will be given of a process of the controller 60 in a situation where, in the delivery configured as described above, signatures with different folding specifications are transported by use of FIGS. 11 to 17.

Here, in the folding machine (not shown) of the printing press 61, as shown in FIGS. 4 and 5, it is possible to select from, for example, three types of folding specifications, the signature 65 which is folded in parallel one time, the signature 66 which is delta-folded, and the signature 67 which is folded in parallel two times. Therefore, the delivery according to the present invention is also capable of supporting all these folding specifications.

First, by use of FIG. 11, a description will be given of a discrimination process at the time of changing the folding specification.

As shown in FIG. 11, in step S1, a folding specification of any of one-time parallel folding, two-time parallel folding and delta folding is newly inputted to the folding specification input part 63. In step S2, it is determined whether or not the current folding specification is the one-time parallel folding. If the result is Yes, in step S3, it is determined whether or not the folding specification which is newly inputted to the folding specification input part 63 in step S1 is the one-time parallel folding. Here, if the result is Yes, the process will end.

Specifically, since the folding specification in this case is changed from the one-time parallel folding to the one-time parallel folding, the controller 60 does not drive the side-guide drive motor 32 and the back-guide drive motor 44, and does not allow the fan-wheel air cylinders 4 and 5, the side-guide rodless cylinder 27, and back-guide rodless air cylinders 52 and 53 to operate. Therefore, the fan wheel members 2*a* and 2*b* remain placed in the rotation positions R1 and R2, the side guide 21 remains placed in the guide position M1', and the back guide members 34*a*, 34*b* and 34*c* remain placed in the guide position N1.

If the result is No in step S3, it is determined in step S4 whether or not the folding specification which is newly inputted to the folding specification input part 63 in step S1 is the delta folding. Here, if the result is Yes, the process continues to a process shown in later-described FIG. 12. That is, the folding specification in this case is changed from the one-time parallel folding to the delta folding.

On the other hand, if the result is No in step S4, the process continues to a process shown in later-described FIG. 13. That is, the folding specification in this case is changed from the one-time parallel folding to the two-time parallel folding.

Moreover, if the result is No in step S2, it is determined in step S5 whether or not the current folding specification is the delta folding. If the result is Yes, it is determined in step S6 whether or not the folding specification which is newly inputted to the folding specification input part 63 in step S1 is the one-time parallel folding. Here, if the result is Yes, the process continues to a process shown in later-described FIG. 14. That is, the folding specification in this case is changed from the delta folding to the one-time parallel folding.

If the result is No in step S6, it is determined in step S7 whether or not the folding specification which is newly inputted to the folding specification input part 63 in step S1 is the delta folding. If the result is Yes, the process will end.

Specifically, since the folding specification in this case is changed from the delta folding to the delta folding, the controller 60 does not drive the side-guide drive motor 32 and the back-guide drive motor 44, and does not allow the fan-wheel air cylinders 4 and 5, the side-guide rodless cylinder 27, and back-guide rodless air cylinders 52 and 53 to operate. Therefore, the fan wheel members 2*a* remains placed in the retraction position r1, the fan wheel members 2*b* remains placed in the rotation position R2, the side guide 21 remains placed in the guide position M2', the back guide member 34*a* remains placed in the retraction position nil, and the back guide members 34*b* and 34*c* remain placed in the guide position N1.

On the other hand, if the result is No in step S7, the process continues to a process shown in later-described FIG. 15. That is, the folding specification in this case is changed from the delta folding to the two-time parallel folding.

Moreover, if the result is No in step S5, it is determined in step S8 whether or not the folding specification which is newly inputted to the folding specification input part 63 in step S1 is the one-time parallel folding. Here, if the result is Yes, the process continues to a process shown in later-described FIG. 16. That is, the folding specification in this case is changed from the two-time parallel folding to the one-time parallel folding.

If the result is No in step S8, it is determined in step S9 whether or not the folding specification which is newly inputted to the folding specification input part 63 in step S1 is the delta folding. If the result is Yes, the process continues to a process shown in later-described FIG. 17. That is, the folding specification in this case is changed from the two-time parallel folding to the delta folding.

If the result is No in step S9, the process will end. Specifically, since the folding specification in this case is changed from the two-time parallel folding to the two-time parallel folding, the controller 60 does not drive the side-guide drive motor 32 and the back-guide drive motor 44, and does not allow the fan-wheel air cylinders 4 and 5, the side-guide rodless cylinder 27, and back-guide rodless air cylinders 52 and 53 to operate. Therefore, the fan wheel members 2*a* and 2*b* remain placed in the retraction positions r1 and r2, the side guide 21 remains placed in the guide position M3, the back guide members 34*a* and 34*b* remain placed in the retraction position nil, and the back guide member 34*c* remains placed in the guide position N1.

Next, by use of FIG. 12, a description will be given of the process at the time of changing the folding specification from the one-time parallel folding to the delta folding.

First, in step SA1, the back-guide drive motor 44 is driven to rotate in the other direction. In step SA2, it is determined whether or not it is detected by the back-guide encoder 45 that the back guide members 34*a*, 34*b* and 34*c* have moved to the retraction position n1. Here, if the result is Yes, the drive of the back-guide drive motor 44 is stopped in step SA3. If the result is No, the detection is continued.

In step SA4, the side-guide rodless air cylinder 27 is allowed to operate in the other direction (toward the upstream side in the transporting direction of the signature). In step SA5, it is determined whether or not the side-guide rodless air cylinder 27 has completed extending in the other direction. In other words, it is determined whether or not the side guide 21 has moved from the guide position M1' to the retraction position m1. Here, if the result is Yes, the fan-wheel air cylinder 4 is allowed to operate in the other direction (toward the frame 1*a* side) in step SA6. If the result is No, the detection is continued.

In step SA7, it is determined whether or not the fan-wheel air cylinder 4 has completed extending. In other words, it is determined whether or not the fan wheel member 2*a* has moved from the guide position R1 to the retraction position r1. Here, if the result is Yes, the back-guide drive motor 32 is driven to rotate in one direction in step SA8. If the result is No, the detection is continued. In step SA9, it is determined whether or not it is detected by the side-guide encoder 33 that the side guide 21 has moved from the retraction position m1 to the retraction position m2. Here, if the result is Yes, the drive of the side-guide drive motor 32 is stopped in step SA10. If the result is No, the detection is continued.

In step SA11, the side-guide rodless air cylinder 27 is allowed to operate in one direction (toward the downstream side in the transporting direction of the signature). In step SA12, it is determined whether or not the side-guide rodless air cylinder 27 has completed extending in one direction. In other words, it is determined whether or not the side guide 21 has moved from the retraction position m2 to the guide position M2'. Here, if the result is Yes, the back-guide drive motor 44 is driven to rotate in one direction in step SA13. If the result is No, the detection is continued.

In step SA14, the back-guide rodless air cylinder 52 is allowed to operate in the other direction (toward the upstream side in the transporting direction of the signature). In step SA15, it is determined whether or not it is detected by the back-guide encoder 45 that the back guide members 34*b* and 34*c* have moved to the guide position N1. Here, if the result is Yes, it is determined in step SA16 whether or not the back-guide rodless air cylinder 52 has completed extending in the other direction. In other words, it is determined whether or not the back guide member 34*a* has moved to the retraction position n1. Here, if the result is Yes, the process will end. If the result is No in step SA15 or SA16, the detection is continued.

Next, by use of FIG. 13, a description will be given of the process at the time of changing the folding specification from the one-time parallel folding to the two-time parallel folding.

First, in step SB1, the back-guide drive motor 44 is driven to rotate in the other direction. In step SB2, it is determined whether or not it is detected by the back-guide encoder 45 that the back guide members 34*a*, 34*b* and 34*c* have moved to the retraction position n1. Here, if the result is Yes, the drive of the back-guide drive motor 44 is stopped in step SB3. If the result is No, the detection is continued.

In step SB4, the side-guide rodless air cylinder 27 is allowed to operate in the other direction. In step SB5, it is determined whether or not the side-guide rodless air cylinder 27 has completed extending in the other direction. In other words, it is determined whether or not the side guide 21 has moved from the guide position M1' to the retraction position m1. Here, if the result is Yes, the fan-wheel air cylinders 4 and 5 are allowed to operate in the other direction (toward the frame 1*a* side) in step SB6. If the result is No, the detection is continued.

In step SB7, it is determined whether or not the fan-wheel air cylinders 4 and 5 have completed extending. In other words, it is determined whether or not the fan wheel members 2*a* and 2*b* have moved from the guide positions R1 and R2 to the retraction positions r1 and r2. Here, if the result is Yes, the side-guide drive motor 32 is driven to rotate in one direction in step SB8. If the result is No, the detection is continued. In step SB9, it is determined whether or not it is detected by the side-guide encoder 33 that the side guide 21 has moved from the retraction position m1 to the retraction position m2. Here, if the result is Yes, the drive of the side-guide drive motor 32 is stopped in step SB10. If the result is No, the detection is continued.

In step SB11, the side-guide rodless air cylinder 27 is allowed to operate in one direction. In step SB12, it is determined whether or not the side-guide rodless air cylinder 27 has completed extending in one direction. In other words, it is determined whether or not the side guide 21 has moved from the retraction position m2 to the guide position M2'. Here, if the result is Yes, the side-guide drive motor 32 is driven to rotate in one direction in step SB13. If the result is No, the detection is continued.

In step SB14, it is determined whether or not it is detected by the side-guide encoder 33 that the side guide 21 has moved from the guide position M2' to the guide position M3'. Here, if the result is Yes, the back-guide drive motor 44 is driven to rotate in one direction in step SB15. If the result is No, the detection is continued. In step SB16, the back-guide rodless air cylinders 52 and 53 are allowed to operate in the other direction (toward the upstream side in the transporting direction of the signature). In step SB17, it is determined whether or not it is detected by the back-guide encoder 45 that the back guide member 34*c* has moved to the guide position N1. Here, if the result is Yes, it is determined in step SB18 whether or not the back-guide rodless air cylinders 52 and 53 have completed extending in the other direction. In other words, it is determined whether or not the back guide members 34*a* and 34*b* have moved to the retraction position n1. Here, if the result is Yes, the process will end. If the result is No in step SB17 or SB18, the detection is continued.

Next, by use of FIG. 14, a description will be given of the process at the time of changing the folding specification from the delta folding to the one-time parallel folding.

First, in step SC1, the back-guide drive motor 44 is driven to rotate in the other direction. In step SC2, it is determined whether or not it is detected by the back-guide encoder 45 that the back guide members 34*b* and 34*c* have moved to the retraction position n1. Here, if the result is Yes, the drive of the back-guide drive motor 44 is stopped in step SC3. If the result is No, the detection is continued.

In step SC4, the side-guide rodless air cylinder 27 is allowed to operate in the other direction. In step SC5, it is determined whether or not the side-guide rodless air cylinder 27 has completed extending in the other direction. In other words, it is determined whether or not the side guide 21 has moved from the guide position M2' to the retraction position m2. Here, if the result is Yes, the fan-wheel air cylinder 4 is allowed to operate in one direction (toward the frame 1*b* side) in step SC6. If the result is No, the detection is continued.

In step SC7, it is determined whether or not the fan-wheel air cylinder 4 has completed retraction. In other words, it is determined whether or not the fan wheel member 2*a* has moved from the retraction position r1 to the guide position R1. Here, if the result is Yes, the back-guide drive motor 32 is driven to rotate in the other direction in step SC8. If the result is No, the detection is continued. In step SC9, it is determined whether or not it is detected by the side-guide encoder 33 that the side guide 21 has moved from the retraction position m2 to the retraction position m1. Here, if the result is Yes, the drive of the side-guide drive motor 32 is stopped in step SC10. If the result is No, the detection is continued.

In step SC11, the side-guide rodless air cylinder 27 is allowed to operate in one direction. In step SC12, it is determined whether or not the side-guide rodless air cylinder 27 has completed extending in one direction. In other words, it is determined whether or not the side guide 21 has moved from the retraction position m1 to the guide position M1'. Here, if the result is Yes, the back-guide rodless air cylinder 52 is allowed to operate in one direction (toward the upstream side in the transporting direction of the signature) in step SC13. If the result is No, the detection is continued.

In step SC14, the back-guide drive motor 44 is driven to rotate in one direction. In step SC15, it is determined whether or not it is detected by the back-guide encoder 45 that the back guide members 34*a*, 34*b* and 34*c* have moved to the guide position N1. Here, if the result is Yes, the process will end. If the result is No, the detection is continued.

Next, by use of FIG. 15, a description will be given of the process at the time of changing the folding specification from the delta folding to the two-time parallel folding.

First, in step SD1, the back-guide drive motor 44 is driven to rotate in the other direction. In step SD2, it is determined whether or not it is detected by the back-guide encoder 45 that the back guide members 34*b* and 34*c* have moved to the retraction position n1. Here, if the result is Yes, the drive of the back-guide drive motor 44 is stopped in step SD3. If the result is No, the detection is continued.

In step SD4, the side-guide rodless air cylinder 27 is allowed to operate in the other direction. In step SD5, it is determined whether or not the side-guide rodless air cylinder 27 has completed extending in the other direction. In other words, it is determined whether or not the side guide 21 has moved from the guide position M2' to the retraction position m2. Here, if the result is Yes, the fan-wheel air cylinder 5 is allowed to operate in the other direction in step SD6. If the result is No, the detection is continued.

In step SD7, it is determined whether or not the fan-wheel air cylinder 5 has completed extending. In other words, it is determined whether or not the fan wheel member 2*b* has moved from the guide position R2 to the retraction position r2. Here, if the result is Yes, the side-guide rodless air cylinder 27 is allowed to operate in one direction in step SD8. If the result is No, the detection is continued. In step SD9, it is determined whether or not the side-guide rodless air cylinder 27 has completed extending in one direction. In other words, it is determined whether or not the side guide 21 has moved from the retraction position m2 to the guide position M2'. Here, if the result is Yes, the side-guide drive motor 32 is driven to rotate in one direction in step SD10. If the result is No, the detection is continued.

In step SD11, it is determined whether or not it is detected by the side-guide encoder 33 that the side guide 21 has moved from the guide position M2' to the guide position M3'. Here, if the result is Yes, the drive of the side-guide drive motor 32 is stopped in step SD12. If the result is No, the detection is continued. In step SD13, the back-guide drive motor 44 is driven to rotate in one direction. In step SD14, the back-guide rodless air cylinder 53 is allowed to operate in the other direction.

In step SD15, it is determined whether or not it is detected by the back-guide encoder 45 that the back guide member 34*c* has moved to the guide position N1. Here, if the result is Yes, it is determined in step SD16 whether or not the back-guide rodless air cylinder 53 has completed extending in the other direction. In other words, it is determined whether or not the back guide member 34*b* has moved to the retraction position n1. Here, if the result is Yes, the process will end. If the result is No in step SD15 or SD16, the detection is continued.

Next, by use of FIG. 16, a description will be given of the process at the time of changing the folding specification from the two-time parallel folding to the one-time parallel folding.

First, in step SE1, the back-guide drive motor 44 is driven to rotate in the other direction. In step SE2, it is determined whether or not it is detected by the back-guide encoder 45 that the back guide member 34*c* has moved to the retraction position n1. Here, if the result is Yes, the drive of the back-guide drive motor 44 is stopped in step SE3. If the result is No, the detection is continued.

In step SE4, the back-guide drive motor 32 is driven to rotate in the other direction. In step SE5, it is determined whether or not it is detected by the side-guide encoder 33 that the side guide 21 has moved from the guide position M3' to the guide position M2'. Here, if the result is Yes, the drive of the side-guide drive motor 32 is stopped in step SE6. If the result is No, the detection is continued.

In step SE7, the side-guide rodless air cylinder 27 is allowed to operate in the other direction. In step SE8, it is determined whether or not the side-guide rodless air cylinder 27 has completed extending in the other direction. In other words, it is determined whether or not the side guide 21 has moved from the guide position M2' to the retraction position m2. Here, if the result is Yes, the fan-wheel air cylinders 4 and 5 are allowed to operate in one direction (toward the frame 1*b* side) in step SE9. If the result is No, the detection is continued.

In step SE10, it is determined whether or not the fan-wheel air cylinders 4 and 5 have completed retraction. In other words, it is determined whether or not the fan wheel members 2*a* and 2*b* have moved from the retraction positions r1 and r2 to the guide positions R1 and R2. Here, if the result is Yes, the back-guide drive motor 32 is driven to rotate in the other direction in step SE11. If the result is No, the detection is continued. In step SE12, it is determined whether or not it is detected by the side-guide encoder 33 that the side guide 21 has moved from the retraction position m2 to the retraction position m1. Here, if the result is Yes, the drive of the side-guide drive motor 32 is stopped in step SE13. If the result is No, the detection is continued.

In step SE14, the side-guide rodless air cylinder 27 is allowed to operate in one direction. In step SE15, it is determined whether or not the side-guide rodless air cylinder 27 has completed extending in one direction. In other words, it is determined whether or not the side guide 21 has moved from the retraction position m1 to the guide position M1'. Here, if the result is Yes, the back-guide drive motor 44 is driven to rotate in one direction in step SE 16. If the result is No, the detection is continued.

In step SE17, the back-guide rodless air cylinders 52 and 53 are allowed to operate in one direction (toward the downstream side in the transporting direction of the signature). In step SE18, it is determined whether or not it is detected by the back-guide encoder 45 that the back guide members 34*a*, 34*b* and 34*c* have moved to the guide position N1. Here, if the result is Yes, the process will end. If the result is No, the detection is continued.

Next, by use of FIG. 17, a description will be given of the process at the time of changing the folding specification from the two-time parallel folding to the delta folding.

First, in step SF1, the back-guide drive motor 44 is driven to rotate in the other direction. In step SF2, it is determined whether or not it is detected by the back-guide encoder 45 that the back guide member 34*c* has moved to the retraction position n1. Here, if the result is Yes, the drive of the back-guide drive motor 44 is stopped in step SF3. If the result is No, the detection is continued.

In step SF4, the back-guide drive motor 32 is driven to rotate in the other direction. In step SF5, it is determined whether or not it is detected by the side-guide encoder 33 that the side guide 21 has moved from the guide position M3' to the guide position M2'. Here, if the result is Yes, the drive of the side-guide drive motor 32 is stopped in step SF6. If the result is No, the detection is continued.

In step SF7, the side-guide rodless air cylinder 27 is allowed to operate in the other direction. In step SF8, it is determined whether or not the side-guide rodless air cylinder 27 has completed extending in the other direction. In other words, it is determined whether or not the side guide 21 has moved from the guide position M2' to the retraction position m2. Here, if the result is Yes, the fan-wheel air cylinder 5 is allowed to operate in one direction in step SF9. If the result is No, the detection is continued.

In step SF10, it is determined whether or not the fan-wheel air cylinder 5 has completed retraction. In other words, it is determined whether or not the fan wheel member 2*b* has moved from the retraction position r2 to the guide position R2. Here, if the result is Yes, the side-guide rodless air cylinder 27 is allowed to operate in one direction in step SF11. If the result is No, the detection is continued. In step SF12, it is determined whether or not the side-guide rodless air cylinder 27 has completed extending in one direction. In other words, it is determined whether or not the side guide 21 has moved from the retraction position m2 to the guide position M2'. Here, if the result is Yes, the back-guide drive motor 44 is driven to rotate in one direction in step SF13. If the result is No, the detection is continued.

In step SF14, the back-guide rodless air cylinder 53 is driven to rotate in one direction. In step SF15, it is determined whether or not it is detected by the back-guide encoder 45 that the back guide members 34*b* and 34*c* have moved to the guide position N1. Here, if the result is Yes, the process will end. If the result is No, the detection is continued.

Thus, the above described operations make it possible to easily move the positions in which the fan wheel members 2*a*, 2*b*, 2*c* and 2*d*, the back guide members 34*a*, 34*b* and 34*c*, and the side guide 21 are placed, even when the fan wheel members 2*a*, 2*b*, 2*c* and 2*d* rotationally transport each of the signatures 65, 66 and 67 which have different folding specifications.

The side guide 21 placed in the guide positions is designed to be moved by the controller 60 in the width direction of the signatures 65, 66 and 67, that is, between the guide positions M1, M2 and M3 and the guide positions M1', M2' and M3', respectively, in response to the drive speed of the printing press 61 (the transporting speed of the signature). This is because of the following reasons. When a signature is transported at a low speed, the signature has little momentum, lacks stability, and is thus transported askew. Therefore, when the side guide is placed in accordance with the length in the width direction of the signature, there is a possibility that the signature bumps into the side guide. In order to avoid this, in the delivery according to the present embodiment, at the time when the drive speed is in a range excluding a speed at which the printing press 61 performs printing in normal operation, especially at the time of starting up (200 rpm or less, for example), the side guide 21 is placed with the side guide 21 spaced apart from the guide positions M1, M2 and M3 to the guide positions M1', M2' and M3' (20 to 80 mm, for example). This prevents the signatures 65, 66 and 67 which have been transported from bumping into the side guide 21, and thereby inhibiting a paper jam and the like from occurring.

In addition, the side guide 21 is so designed that the side guide 21 gradually moves from the guide positions M1', M2' and M3' to the guide positions M1, M2 and M3, respectively, as the drive speed of the printing press 61 increases, and, when the printing press 61 reaches normal operation, the side guide 21 is eventually placed in the guide position M1, M2 or M3. Incidentally, from the time of normal operation to the time of shutting down of the printing press 61, the side guide 21 may be placed in the guide positions M1', M2' and M3'.

It should be noted that, while the operation of the printing press 61 is started with the side guide 21 placed in the guide position M1', M2' or M3', and the side guide 21 is moved to the guide position M1, M2 or M3 at the time of normal operation in the present embodiment as described above, the side guide 21 may be placed in the guide place M1, M2 or M3 from before starting up the printing press 61.

Here, as another embodiment, the back guide members 34*a*, 34*b* and 34*c* placed in the guide position N1 may be designed to be moved in the longitudinal direction of the signatures 65, 66 and 67, that is, between the guide position N1 and the retraction position n1, in response to the drive speed of the printing press 61 by the controller 60. This is because of the following reasons. When a signature is transported at a low speed, the signature has little momentum, lacks stability, and is thus transported askew. Therefore, when the back guide is placed in accordance with the length in the longitudinal direction of the signature, there is a possibility that the signature bumps into the back guide. In order to avoid this, in the delivery according to the present embodiment, at the time when the drive speed is in a range excluding a speed at which the printing press 61 performs printing in normal operation, especially at the time of starting up (200 rpm or less, for example), the back guide members 34*a*, 34*b* and 34*c* are placed with the back guide members 34*a*, 34*b* and 34*c* spaced apart from the guide position N1 to the retraction position n1 (20 to 80 mm, for example). This prevents the signatures 65, 66 and 67 which have been transported from bumping into the back guide members 34*a*, 34*b* and 34*c*, and thereby preventing a paper jam and the like from occurring.

In addition, the back guide members 34*a*, 34*b* and 34*c* are so designed that the back guide members 34*a*, 34*b* and 34*c* gradually move from the retraction position n1 to the guide position N1 as the drive speed of the printing press 61 increases, and, when the printing press 61 reaches normal operation, the back guide members 34*a*, 34*b* and 34*c* are eventually placed in the guide position N1. Incidentally, the back guide members 34*a*, 34*b* and 34*c* are designed to move from the guide position N1 to the retraction position n1, from the time of normal operation to the time of shutting down of the printing press 61.

Thus, with the delivery according to the present invention, since the delivery includes: the fan wheel members 2*a*, 2*b*, 2*c* and 2*d* for holding and rotationally transporting the signatures 65, 66 and 67 delivered from the printing press 61; the pair of side guides 20 and 21 for restricting the signatures 65, 66 and 67 in the width direction which are held in the fan wheel members 2*a*, 2*b*, 2*c* and 2*d*; the side-guide rodless air cylinder 27 for moving at least one side guide 21 between the side-guide guide positions M1, M2, M3, M1', M2' and M3' for guiding the signatures 65, 66 and 67 and the side-guide retraction positions m1 and m2 for retraction to the outside of the fan wheel members 2*a*, 2*b*, 2*c* and 2*d* in the radial direction thereof; the side-guide drive motor 32 for moving at least one side guide 21 in the width direction of the signatures 65, 66 and 67; and the controller 60 which controls the side-guide rodless air cylinder 27 and the side-guide drive motor 32 so that the side guide 21 moves in accordance with the lengths in the width direction of the signatures 65, 66 and 67, it is possible to automatically move the side guide 21 at the time of changing the folding specification.

Moreover, since the retraction positions m1 and m2 are placed outside the peripheries of the fan wheel members 2*a*, 2*b*, 2*c* and 2*d*, it is possible to prevent the side guide 21 from coming into contact with the fan wheel members 2*a*, 2*b*, 2*c* and 2*d* even when the side guide 21 moves between the retraction positions m1 and m2.

Moreover, since the rodless air cylinder 27 for moving the signatures 65, 66 and 67 in the transporting direction is supported by the supporting plate 28 which is moved by the side-guide drive motor 32 in the paper width direction which is the direction orthogonal to the transporting direction, and the supporting plate 28 is supported by the frame 1*a* via the supporting block 29, it is possible to easily control the side guide 21.

Moreover, since the delivery includes: the back guide members 34*a*, 34*b* and 34*c*, which are provided between the pair of side guides 20 and 21, and which guide the rear ends of the signatures 65, 66 and 67 which are held in the fan wheel members 2*a*, 2*b*, 2*c* and 2*d*; and the back-guide drive motor 44 and the back-guide rodless air cylinders 52 and 53 for moving the back guide members 34*a*, 34*b* and 34*c* between the guide position N1 for guiding the signatures 65, 66 and 67 and the retraction position n1 for retraction to the outside of the fan wheel members 2*a*, 2*b*, 2*c* and 2*d* in the radial direction thereof, and the retraction position n1 is placed in such a manner that the side guide 21 can move in the width direction of the signatures 65, 66 and 67, it is possible to automatically move the back guide members 34*a*, 34*b* and 34*c* in synchronization with the movement of the fan wheel members 2*a* and 2*b*.

Moreover, since the controller 60 moves the side guide 21 to the retraction position m1 or m2 after moving the back guide member 34*a*, 34*b* and 34*c* to the retraction position n1, and the controller 60 moves the back guide members 34*a*, 34*b* and 34*c* to the guide position N1 after moving the side guide 21 to the guide position M1, M2, M3, M1', M2' or M3', it is possible to prevent the side guide 21 from coming into contact with the back guide members 34*a*, 34*b* and 34*c*.

Moreover, since the controller 60 moves the side guide 21 to the retraction position m1 or m2 after moving the back guide members 34*a*, 34*b* and 34*c* to the retraction position n1, and then moves the side guide 21 to the guide position M1, M2, M3, M1', M2' or M3', it is possible to prevent the side guide 21 from coming into contact with the back guide members 34*a*, 34*b* and 34*c*.

Moreover, since the back-guide drive motor 44 and the back-guide rodless air cylinders 52 and 53 are provided, it is possible to easily move the back guide members 34*a*, 34*b* and 34*c* to the guide position N1 and the retraction position n1 in accordance with the length in the width direction of the signatures 65, 66 and 67.

Moreover, since the back guide member 34*c* is fixed to the guide block 38, and the back guide members 34*b* and 34*c* are inserted into the guide block 38 in such a manner that the forward movement of the back guide members 34*b* and 34*c* is restricted, it is possible to easily control the back guide members 34*a*, 34*b* and 34*c*.

Moreover, since the back guide members 34*a*, 34*b* and 34*c* are moved between the guide position N1 and the retraction position n1 by use of the movement of the guide block 38, it is possible to easily control the back guide members 34*a*, 34*b* and 34*c* in a simple configuration.

Moreover, since the other side guide 20 is fixed near the back guide member 34*c*, it is possible to stably guide one end of the signature 65, 66 or 67.

Moreover, since the fan-wheel members 2*a* and 2*b* are supported freely movably in the width direction of the signatures 65, 66 and 67, it is possible to automatically move the fan wheel members 2*a* and 2*b* at the time of changing the folding specification.

Moreover, since the fan-wheel air cylinders 4 and 5, which move the fan wheel members 2*a* and 2*b* in the width direction of the signatures 65, 66 and 67, are provided, it is possible to easily control the fan wheel members 2*a* and 2*b*.

Moreover, since the controller 60 moves the back guide members 34*a*, 34*b* and 34*c* to the retraction position n1, moves the side guide 21 to the retraction position m1 or m2, moves the fan wheel members 2*a* and 2*b* to a position corresponding to the signature 65, 66 or 67, moves the side guide 21 to the guide position M1, M2, M3, M1', M2' or M3', and then moves the back guide members 34*a*, 34*b* and 34*c* to the guide position N1, it is possible to easily control the fan wheel members 2*a* and 2*b*, side guide 21, and the back guide members 34*a*, 34*b* and 34*c* and to prevent the contact thereof with another at the time of changing the folding specification.

In addition, since it is possible to preserve an appropriate amount of clearance by moving the side guide 21 between the guide positions M1, M2 and M3 and the guide positions M1', M2' and M3', respectively, in accordance with the drive speed of the printing press 61, it is possible to prevent the signatures 65, 66 and 67 from bumping into the side guide 21. In particular, at the time of starting up the printing press, even if the signatures 65, 66 and 67 are transported askew, it is possible to surely prevent the signatures 65, 66 and 67 from bumping into the side guide 21 because the side guide 21 is placed in the guide position M1', M2' or M3'.

Moreover, since it is possible to preserve an appropriate amount of clearance by moving the back guide members 34*a*, 34*b* and 34*c* between the guide position N1 and the retraction position n1 in accordance with the drive speed of the printing press 61, it is possible to prevent the signatures 65, 66 and 67 from bumping into the back guide members 34*a*, 34*b* and 34*c*. In particular, at the time of starting up the printing press, even if the signatures 65, 66 and 67 are transported askew, it is possible to surely prevent the signatures 65, 66 and 67 from bumping into the back guide members 34*a*, 34*b* and 34*c* because the back guide members 34*a*, 34*b* and 34*c* are placed in the retraction position n1.

Thus, such automation improves the workability of the position adjustment of the fan wheel members 2*a* and 2*b*, the side guide 21, and the back guide members 34*a*, 34*b* and 34*c* by an operator, and eliminates the attachment failure, thereby preventing a paper jam of the signature.

It should be noted that the side guide 20 may be provided with an air cylinder, a drive motor and the like, so that the side guide 20 is allowed to be able to move in the radial direction of the fan wheel 2 or in the width direction of the signatures 65, 66 and 67 as in the case of the side guide 21. In addition, although the fan wheel 2 includes four fan wheel members 2*a*, 2*b*, 2*c* and 2*d*, and the back guide 34 includes three guide members 34*a*, 34*b* and 34*c* in the present embodiment, the numbers of these members are not limited to these numbers. Furthermore, instead of performing control via the controller 60 only, it is also possible to adopt a configuration in which the fan wheel 2, the side guide 21 and the back guide 34 are individually provided with a controller, and the controllers are connected.

The present invention can be applied to a delivery of a folding machine included in a rotary press, the delivery automatically performing position adjustment of guide members in accordance with the size of a signature, and moving of the guide members in response to the drive speed of the printing press at the time of changing the folding specification.

With a delivery according to the first aspect, since the delivery includes:

a fan wheel holding and rotationally transporting a sheet delivered from a printing press;

a pair of side guides restricting the sheet in the width direction which is held in the fan wheel;

side-guide radial-direction moving means for moving at least one side guide between a side-guide guide position for guiding the sheet and a side-guide retraction position for retraction to the outside of the fan wheel in the radial direction thereof;

side-guide width-direction moving means for moving at least one side guide in the width direction of the sheet; and control means for controlling the side-guide radial-direction moving means and the side-guide width-direction moving means in such a manner that the one side-guide moves in accordance with the length in the width direction of the sheet, it is possible to automatically move the side guide at the time of changing the folding specification.

With a delivery according to the second aspect, since, in the delivery according to the first aspect, the side-guide retraction positions are placed outside the peripheries of the fan wheel when the side guide is moved in the axis direction, it is possible to prevent the side guide from coming into contact with the fan wheel.

With a delivery according to the third aspect, since, in the delivery according to the first aspect, the side-guide radial-direction moving means and the side-guide width-direction moving means are made as side-guide moving means in which the side-guide width-direction moving means supports the side-guide radial-direction moving means, it is possible to easily control the side guide.

With a delivery according to the fourth aspect, since, in the delivery according to the third aspect, the side-guide radial-direction moving means is a rodless air cylinder, and the side-guide width-direction moving means is a motor, it is possible to easily control the side guide.

With a delivery according to the fifth aspect, since, in the delivery according to the third aspect, the delivery further includes:

a back guide which is provided between the pair of side guides, and which guides the rear end of the sheet which is held in the fan wheel; and back guide moving means moving the back guide between a back-guide guide position for guiding the sheet and a side-guide retraction position for retraction to the outside of the fan wheel in the radial direction thereof, wherein the side-guide retraction position is placed in such a manner that the side guide can move in the width direction of the sheet, it is possible to automatically move the back guide in synchronization with the movement of the fan wheel.

With a delivery according to the sixth aspect, since, in the delivery according to the fifth aspect, the control means moves the side guide to the side-guide retraction position after moving the back guide to the side-guide retraction position, and the control means moves the back guide to the back-guide guide position after moving the side guide to the side-guide guide position, it is possible to prevent the side guide from coming into contact with the back guide.

With a delivery according to the seventh aspect, since, in the delivery according to the first aspect, the delivery further includes:

a back guide which is provided between the pair of side guides, and which guides the rear end of the sheet which is held in the fan wheel; and back guide moving means moving the back guide between a back-guide guide position for guiding the sheet and a side-guide retraction position for retraction to the outside of the fan wheel in the radial direction thereof, wherein the control means moves the side guide to the side-guide retraction position after moving the back guide to the side-guide retraction position, and then moves the side guide to the side-guide guide position, it is possible to prevent the side guide from coming into contact with the back guide.

With a delivery according to the eighth aspect, since, in the delivery according to the fifth aspect, the back guide includes a plurality of back guide members in the width direction of the sheet, and that the plurality of the back guide members are individually provided with the back guide moving means, it is possible to allow the plurality of back guide members to perform guiding in accordance with the length in the width direction of the sheet.

With a delivery according to the ninth aspect, since, in the delivery according to the eighth aspect, one back guide member out of the plurality of back guide members is fixed to a guide block, and another back guide member is inserted into the guide block and the forward movement thereof is restricted by the guide block, it is possible to easily control the back guide members.

With a delivery according to the 10th aspect, since, in the delivery according to the ninth aspect, the plurality of back guide members are moved between the back-guide guide position and the side-guide retraction position by use of the movement of the guide block, it is possible to easily control the back guide members.

With a delivery according to the 11th aspect, since, in the delivery according to the ninth aspect, the other side guide is immovably supported and is fixed near the back guide member, it is possible to stably guide the sheet.

With a delivery according to the 12th aspect, since, in the delivery according to the first aspect, the fan wheel includes a plurality of fan wheel members in the width direction of the sheet, and that at least one fan wheel member out of the plurality of fan wheel members is supported freely movably in the width direction of the sheet, it is possible to automatically move the fan wheel members at the time of changing the folding specification.

With a delivery according to the 13th aspect, since, in the delivery according to the 12th aspect, fan wheel moving means moving the plurality of fan wheel members in the width direction of the sheet is provided, it is possible to easily control the fan wheel members.

With a delivery according to the 14th aspect, since, in the delivery according to the fifth aspect, the control means moves the back guide to the side-guide retraction position, moves the side guide to the side-guide retraction position, moves the fan wheel to a position corresponding to the sheet, moves the side guide to the side-guide guide position, and then moves the back guide to the back-guide guide position, it is possible to easily control the side guide, the fan wheel and the back guide and to prevent the contact thereof with another at the time of changing the folding specification.

What is claimed is:

1. A delivery, comprising:

a fan wheel holding and rotationally transporting a sheet delivered from a printing press;

a pair of side guides restricting the sheet in a width direction which is held in the fan wheel;

side-guide radial-direction moving means for moving at least one of the pair of side guides between a side-guide guide position for guiding the sheet and a side-guide retraction position for retraction to an outside of the fan wheel in a radial direction thereof;

side-guide width-direction moving means for moving the at least one of the pair of side guides in the width direction of the sheet; and control means for controlling the side-guide radial-direction moving means and the side-guide width-direction moving means in such a manner that the at least one of the pair of side guides moves in accordance with a length of the sheet in the width direction of the sheet.

2. The delivery according to claim 1, wherein side-guide retraction portions the at least one of the pair of side guides is placed outside peripheries of the fan wheel when the at least one of the pair of side guides is moved in the width direction.

3. The delivery according to claim 1, wherein the side-guide radial-direction moving means and the side-guide width-direction moving means are made as side-guide moving means in which the side-guide width-direction moving means supports the side-guide radial-direction moving means.

4. The delivery according to claim 3, wherein the side-guide radial-direction moving means is a rodless air cylinder, and the side-guide width-direction moving means is a motor.

5. The delivery according to claim 3, further comprising:

a back guide which is provided between the pair of side guides, and which guides a rear end of the sheet which is held in the fan wheel; and back guide moving means moving the back guide between a back-guide guide position for guiding the sheet and a back-guide retraction position for retraction to the outside of the fan wheel in the radial direction thereof, wherein the side-guide retraction position is placed in such a manner that the at least one of the pair of side guides can move in the width direction of the sheet.

6. The delivery according to claim 5, wherein the control means moves the at least one of the pair of side guides to the side-guide retraction position after moving the back guide to the back-guide retraction position, and the control means moves the back guide to the back-guide guide position after moving the at least one of the pair of side guides to the side-guide guide position.

7. The delivery according to claim 1, further comprising:

a back guide which is provided between the pair of side guides, and which guides a rear end of the sheet which is held in the fan wheel; and back guide moving means moving the back guide between a back-guide guide position for guiding the sheet and a back-guide retraction position for retraction to the outside of the fan wheel in the radial direction thereof, wherein the control means moves the at least one of the pair of side guides to the side-guide retraction position after moving the back guide to the back-guide retraction position, and then moves the at least one of the pair of side guides to the side-guide guide position.

8. The delivery according to claim 5, wherein the back guide includes a plurality of back guide members in the width direction of the sheet, and each of the plurality of the back guide members is provided with the back guide moving means.

9. A delivery, comprising:

a fan wheel holding and rotationally transporting a sheet delivered from a printing press;

a pair of side guides restricting the sheet in a width direction which is held in the fan wheel;

side-guide radial-direction moving means for moving at least one of the pair of side guides between a side-guide guide position for guiding the sheet and a side-guide retraction position for retraction to an outside of the fan wheel in a radial direction thereof;

side-guide width-direction moving means for moving the at least one of the pair of side guides in the width direction of the sheet;

control means for controlling the side-guide radial-direction moving means and the side-guide width-direction moving means in such a manner that the at least one of the pair of side guides moves in accordance with a length of the sheet in the width direction of the sheet, a back guide which is provided between the pair of side guides, and which guides a rear end of the sheet which is held in the fan wheel; and back guide moving means moving the back guide between a back-guide guide position for guiding the sheet and a back-guide retraction position for retraction to the outside of the fan wheel in the radial direction thereof, wherein the side-guide radial-direction moving means and the side-guide width-direction moving means are made as side-guide moving means in which the side-guide width-direction moving means supports the side-guide radial-direction moving means, wherein the side-guide retraction position is placed in such a manner that the side guide can move in the width direction of the sheet, wherein the back guide includes a plurality of back guide members in the width direction of the sheet, and each of the plurality of the back guide members is provided with the back guide moving means, and wherein one back guide member out of the plurality of back guide members is fixed to a guide block, and another back guide member is inserted into the guide block and a forward movement thereof is restricted by the guide block.

10. The delivery according to claim 9, further comprising:

the plurality of back guide members are moved between the back-guide retraction position and the back-guide guide position by use of the forward movement of the guide block.

11. The delivery according to claim 9, wherein another one of the pair of side guides is immovably supported and is fixed adjacent to the back guide member fixed to the guide block.

12. The delivery according to claim 1, wherein the fan wheel includes a plurality of fan wheel members in the width direction of the sheet, and at least one fan wheel member out of the plurality of fan wheel members is supported movably in the width direction of the sheet.

13. A delivery, comprising:

a fan wheel holding and rotationally transporting a sheet delivered from a printing press;

a pair of side guides restricting the sheet in a width direction which is held in the fan wheel;

side-guide radial-direction moving means for moving at least one of the pair of side guides between a side-guide guide position for guiding the sheet and a side-guide retraction position for retraction to an outside of the fan wheel in a radial direction thereof;

side-guide width-direction moving means for moving the at least one of the pair of side guides in the width direction of the sheet; and control means for controlling the side-guide radial-direction moving means and the side-guide width-direction moving means in such a manner that the at least one of the pair of side guides moves in accordance with a length of the sheet in the width direction of the sheet, wherein the fan wheel includes a plurality of fan wheel members in the width direction of the sheet, and at least one fan wheel member out of the plurality of fan wheel members is supported movably in the width direction of the sheet, and wherein fan-wheel moving means moving the at least one fan wheel member in the width direction of the sheet is provided.

14. A delivery, comprising:

a fan wheel holding and rotationally transporting a sheet delivered from a printing press;

a pair of side guides restricting the sheet in a width direction which is held in the fan wheel;

side-guide radial-direction moving means for moving at least one of the pair of side guides between a side-guide guide position for guiding the sheet and a side guide retraction position for retraction to an outside of the fan wheel in a radial direction thereof;

side-guide width-direction moving means for moving the at least one of the pair of side guides in the width direction of the sheet;

control means for controlling the side-guide radial-direction moving means and the side-guide width-direction moving means in such a manner that the at least one of the pair of side guides moves in accordance with a length of the sheet in the width direction of the sheet, a back guide which is provided between the pair of side guides, and which guides a rear end of the sheet which is held in the fan wheel; and back guide moving means moving the back guide between a back-guide guide position for guiding the sheet and a back guide retraction position for retraction to the outside of the fan wheel in the radial direction thereof, wherein the side-guide radial-direction moving means and the side-guide width-direction moving means are made as side-guide moving means in which the side-guide width-direction moving means supports the side-guide radial-direction moving means, wherein the side-guide retraction position is placed in such a manner that the side guide can move in the width direction of the sheet, and wherein the control means moves the back guide to the back-guide retraction position, moves the at least one of the pair of side guides to the side-guide retraction position, moves the fan wheel to a position corresponding to the sheet, moves the at least one of the pair of side guides to the side-guide guide position, and then moves the back guide to the back-guide guide position.

15. The delivery according to claim 1, further comprising:

a folding specification input part in which a folding specification is inputted, wherein the control means controls the side-guide radial-direction moving means and the side-guide width-direction moving means on the basis of the folding specification inputted in the folding specification input part.

16. The delivery according to claim 9, further comprising:

a folding specification input part in which a folding specification is input, wherein the control means controls the side-guide radial-direction moving means, the side-guide width-direction moving means, and the back-guide moving means on the basis of the folding specification inputted in the folding specification input part.

17. The delivery according to claim 13, further comprising:

a folding specification input part in which a folding specification is input, wherein the control means controls the side-guide radial-direction moving means, the side-guide width-direction moving means, and the fan-wheel moving means on the basis of the folding specification inputted in the folding specification input part.

* * * * *